US006559560B1

(12) United States Patent
Jin et al.

(10) Patent No.: US 6,559,560 B1
(45) Date of Patent: May 6, 2003

(54) TRANSMISSION CONTROL APPARATUS USING THE SAME ISOLATION TRANSFORMER

(75) Inventors: Dongzhi Jin, Chiba (JP); Fumihiko Abe, Chiba (JP); Hajime Mochizuki, Tokorozawa (JP)

(73) Assignee: Furukawa Electric Co., Ltd., Tokyo (JP)

( * ) Notice: Subject to any disclaimer, the term of this patent is extended or adjusted under 35 U.S.C. 154(b) by 89 days.

(21) Appl. No.: 09/671,691

(22) Filed: Sep. 28, 2000

Related U.S. Application Data

(62) Division of application No. 09/254,385, filed as application No. PCT/JP98/03006 on Jul. 3, 1998, now Pat. No. 6,512,437.

(30) Foreign Application Priority Data

| | | |
|---|---|---|
| Jul. 3, 1997 | (JP) | 9-178608 |
| Dec. 17, 1997 | (JP) | 9-347990 |
| Mar. 31, 1998 | (JP) | 10-87253 |
| Apr. 3, 1998 | (JP) | 10-92007 |
| Apr. 9, 1998 | (JP) | 10-97784 |

(51) Int. Cl.[7] ..... H01F 21/04
(52) U.S. Cl. ..... 307/104; 336/130
(58) Field of Search ..... 307/104; 336/130, 336/131

(56) References Cited

U.S. PATENT DOCUMENTS

| | | | | |
|---|---|---|---|---|
| 4,321,572 A | | 3/1982 | Studer | |
| 4,529,956 A | | 7/1985 | Atherton | |
| 4,754,180 A | | 6/1988 | Kiedrowski | |
| 4,901,069 A | * | 2/1990 | Veneruso | 336/129 |
| 5,055,775 A | * | 10/1991 | Scherz et al. | 336/120 |
| 5,229,652 A | * | 7/1993 | Hough | 307/104 |
| 5,296,830 A | | 3/1994 | Tamada et al. | |
| 5,315,279 A | * | 5/1994 | Ito et al. | 336/178 |
| 5,347,256 A | * | 9/1994 | Yumiki et al. | 336/120 |
| 5,438,496 A | * | 8/1995 | Meur et al. | 363/16 |
| 5,442,956 A | * | 8/1995 | Persson | 73/118.1 |
| 5,498,911 A | * | 3/1996 | Bossler et al. | 307/10.1 |
| 5,594,176 A | * | 1/1997 | Kiefer | 324/238 |
| 5,810,606 A | * | 9/1998 | Ballast et al. | 385/26 |
| 5,821,632 A | * | 10/1998 | Normann et al. | 307/10.1 |
| 5,856,710 A | * | 1/1999 | Baughman et al. | 280/735 |
| 5,945,744 A | * | 8/1999 | Dobler et al. | 307/10.1 |
| 5,994,788 A | * | 11/1999 | Dobler et al. | 307/10.1 |
| 6,045,527 A | * | 4/2000 | Appelbaum et al. | 604/22 |
| 6,147,416 A | * | 11/2000 | Mitsuzuka | 200/61.54 |
| 6,175,461 B1 | * | 1/2001 | Fukuda et al. | 360/272 |
| 6,189,919 B1 | * | 2/2001 | Sinnhuber et al. | 188/377 |
| 6,388,548 B1 | * | 5/2002 | Saito et al. | 336/131 |

FOREIGN PATENT DOCUMENTS

| | | |
|---|---|---|
| JP | 59-8308 | 1/1984 |
| JP | 59-149616 | 10/1984 |
| JP | 59-173316 | 11/1984 |
| JP | 60-90809 | 6/1985 |
| JP | 05-347216 | 12/1993 |
| JP | 08-51041 | 2/1996 |
| JP | 08-322166 | 12/1996 |
| JP | 06-091373 | 7/1997 |
| JP | 2001-10516 | * 1/2001 |

* cited by examiner

*Primary Examiner*—Brian Sircus
*Assistant Examiner*—Roberto J. Rios
(74) *Attorney, Agent, or Firm*—Frishauf, Holtz, Goodman & Chick, P.C.

(57) ABSTRACT

An isolation transformer is provided having primary and secondary cores (2, 4) and primary and secondary coils (3, 5), with the primary coil and the secondary coil being disposed with a gap G provided therebetween. Each of the primary coil and the secondary coil is formed of a wire having at least two substantially parallel long sides, and a length of the two long sides in each of the wires is set to be longer than a distance between the two long sides in each of the wires. Each of the wires is wound to have a plurality of turns in a manner such that an outer one of the two long sides of each inner one of the turns is adjacent to an inner one of the two long sides of each respective adjacent outer one of the turns.

1 Claim, 21 Drawing Sheets

TRANSMISSION CONTROL APPARATUS USING THE SAME ISOLATION TRANSFORMER

This application is a division of Ser. No. 09/254,385, filed Mar. 2, 1999, now U.S. Pat. No. 6,512,437, which is a 371 of PCT/JP98/03006 filed Ju. 3, 1998.

TECHNICAL FIELD

This invention relates to an isolation transformer and a transmission control apparatus using the isolation transformer.

BACKGROUND ART

The rotary transformer which is one type of the isolation transformer has been frequently used in electric appliances such as video machines.

In an ordinary transformer, two coils are constructed to be rotatable relative to each other, cores having a high relative magnetic permeability are employed to increase the coupling coefficient of the coils, and a gap between the cores (coils) is set to an order of several $\mu$m. If the coils coupling coefficient is very high, self inductance and mutual inductance of the two coils cancel out each other, and therefore the I/O impedance of a transformer can be designed to be small. Therefore, in the ordinary rotary transformer, impedance matching with a load can be carried out easily.

In such a rotary transformer, if the gap between the cores deflects during a relative rotation between two coils, the coupling condition between the coils is affected. Thus, production accuracy of components must be controlled strictly. Specifically in case of use in an environment having a violent vibration, if the absolute value of the gap is small, the coupling condition of the coil may be largely affected by a minute vibration, which is disadvantageous from the viewpoint of production cost.

On the other hand, if a necessity of transmitting a large-current, large-volume electric energy at a high speed occurs when the isolation transformer is used under a low voltage, impedance matching between the coil and load is very important for the isolation transformer. For this purpose, in the isolation transformer, it can be considered to reduce the equivalent relative magnetic permeability of its magnetic circuit by increasing the gap between the cores, to reduce coil inductance by decreasing the number of windings of the coil, and to reduce DC resistance of the coil, as well as other measures. However, because energy is transmitted instantaneously, the transmission frequency needs to be set high. In this case, the higher the frequency, the larger the coil impedance becomes.

The above problems can be solved by suppressing a reduction of the coupling condition between the coils even if the gap between the cores of the isolation transformer is enlarged.

On the other hand, as a non-contact type electric energy transmission apparatus, there is a type using the rotary transformer (a kind of isolation transformer). This kind of the transmission apparatus transmits electric energy supplied from a power source to a load via the aforementioned rotary transformer. For example as disclose in Unexamined Japanese Patent Publication (KOKAI) No. 6-191373, this apparatus is used as an apparatus for instantaneously activating a shot-firing device (load) of an automotive air bag.

The aforementioned shot-firing device is activated by applying a large current of about several A in a short time of, for example, less than 2–30 m second. As the aforementioned electric energy transmission apparatus, specifically, a rotary transformer, it is required that its transmission efficiency is high enough to achieve a large-current electric energy transmission. Further, the isolation transformer is required to have an excellent high frequency characteristic to achieve an instantaneous electric energy transmission, and generally, it is desirable to set the transmission frequency over about 10 kHz.

From this viewpoint, various considerations have been taken on the isolation transformer and recently, a flat opposing type inductive, isolation transformer has been much expected.

The flat opposing type isolation transformer has a structure in which primary and secondary cores provided with primary and secondary coils respectively, mounted in each of annular concave portions formed in their opposing faces so that they have a symmetrical shape with respect to an axis, are arranged symmetrically in terms of plane via a predetermined gap.

In the isolation transformer having such a structure, a factor important for achieving highly efficient electric energy transmission is coupling efficiency between the aforementioned two coils. For this purpose, it is a requirement to make magnetic flux as large as possible, generated in the primary coil interlink with the secondary coil, and to reduce leakage of the magnetic flux. Therefore, much effort has been taken to produce the aforementioned cores with a high magnetic permeability material and to reduce the aforementioned gap as much as possible.

However, there is a limitation in reduction of the gap between the cores and there are following problems. That is, even if a fine gap is set, it is very difficult to maintain that gap at a high accuracy because of an influence of vibration, generated heat and the like. For example, if this kind of the isolation transformer is incorporated in a vehicle as a rotary transformer, the opposing distance between the stator and rotor largely changes due to vibration, generated heat and the like. Thus, if the change rate is of the same order as the gap width, the coupling condition of the isolation transformer largely changes so that its electric transmission efficiency largely changes. That is, as the gap is reduced, the change in transmission efficiency due to the gap change is increased. Therefore, it is difficult to raise the transmission efficiency high enough and stabilize the transmission efficiency in the isolation transformer.

Further, in the isolation transformer, if the gap is reduced, the effective permeability of a magnetic path (magnetic circuit) formed by the cores becomes substantially the same order as the magnetic permeability of the core itself. However, because in the isolation transformer, the coil inductance is increased, a high voltage is necessary for realizing a large current transmission. However, because a 12-V battery is exclusively used as a power source of the vehicle, a boosting circuit for a large current as disclosed in Unexamined Japanese Patent Publication (KOKAI) No. 6-191373 is necessary. Therefore, there occurs such a disadvantage that the isolation transformer has a higher cost.

Further, in some type of conventional transmission control apparatuses, the rotary transformer (a kind of isolation transformers) is used in a steering portion of a vehicle to ignite its air bag from the column side in a non-contact manner. For example, Unexamined Japanese Patent Publication (KOKAI) No. 8-322166 has disclosed an idea in which power transmission necessary for air bag ignition and other signal transmission are achieved in interactive ways by using a rotary transformer having a single shaft structure.

In case of ignition of the air bag, the air bag needs to be activated by supplying a current of several A for more than several tens m seconds instantaneously since detection of a collision to a shot-firing device having a resistance as low as 1–3Ω under a low voltage (the vehicle battery is exclusively 12 V).

In case of power transmission necessary for ignition of the air bag, to satisfy this requirement, the aforementioned conventional transmission control apparatus supplies a small power gradually to charge a capacitor provided on the shaft side with a necessary electric power. When an ignition of the air bag is instructed, the aforementioned instruction signal is multiplex-transmitted from the column side to the shaft side via the rotary transformer by carrier wave. If the ignition is necessary after a necessity of the ignition is determined, the aforementioned capacitor is discharged to supply a large current necessary for the ignition thereby activating the shot-firing device. A communication signal from the shaft side, for example, a signal of ON/OFF of a horn (klaxon) switch or the like is multiplex-transmitted via the rotary transformer.

Because in the aforementioned transmission control apparatus, when the ignition of the air bag is instructed, the aforementioned instruction signal is transmitted to the secondary side of the rotary transformer with the carrier wave so as to determine the necessity of an ignition and after that, the aforementioned shot-firing device is activated, there occurs a difference of time between the instruction and a start of supplying a current to the shot-firing device. Particularly in the aforementioned apparatus, because interactive communication is carried out between the shaft side and column side, the transmission direction is controlled by information frame timing adjustment. Therefore, in the aforementioned apparatus, a delay occurs by a frame time at most in the interactive direction and further, a circuit for separating signals to be transmitted in the interactive direction is necessary, thereby leading to complexity of the circuit.

Because in the aforementioned apparatus, a quantity of power for use in power transmission is minute, it takes a time to charge the capacitor. Thus, if the capacitor is being charged even when the instance when the air bag is required to be ignited comes, there is a possibility that the ignition is impossible.

The resistance of a shot-firing resistor for use in the shot-firing device is very small as described above. Therefore, to supply a large current instantaneously to the secondary side to feed to the shot-firing resistor, it is necessary to suppress the impedance of the secondary coil and it is desirable to suppress the number of the coil windings.

On the other hand, in communication signal transmission, it is desirable that the impedance of the coil is as high as possible to suppress power consumption. Therefore, the number of the coil windings is desired to be large. Thus, it comes about that there are contradictory favorable impedances.

That is, the aforementioned apparatus selectively uses the frequency by using a relatively high frequency for signal transmission and a relatively low frequency for ignition of the air bag.

The present invention has been achieved in view of the above described problems, and a first object of the invention is to provide an isolation transformer capable of inhibiting a drop of the coupling condition between the coils even if the gap between the cores is enlarged.

A second object of the invention is to provide an isolation transformer having an excellent high frequency characteristic and a high transmission efficiency capable of transmitting a large current of electric energy instantaneously with a simple structure.

A third object of the invention is to provide a transmission control apparatus capable off igniting an air bag surely by supplying a current without a delay of time when the ignition of the air bag is required and further capable of achieving signal transmission between the primary side and secondary side of the isolation transformer effectively.

DISCLOSURE OF THE INVENTION

To achieve the first object, the present invention provides an isolation transformer comprising primary and secondary cores and primary and secondary coils, with the primary coil and the secondary coil being disposed with a gap provided therebetween. Each of the primary coil and the secondary coil is formed of a wire having at least two substantially parallel long sides, and a length of the two long sides in each of the wires is set to be longer than a distance between the two long sides in each of the wires. Each of the wires is wound to have a plurality of turns in a manner such that an outer one of the two long sides of each inner one of the turns is adjacent to an inner one of the two long sides of each respective adjacent outer one of the turns.

Preferably, the primary coil and the secondary coil have an even number of windings in the axial direction or radius direction while a sharp angle formed between a line connecting centers on both ends of an insulating gap between both windings in a cross section of a diameter direction of the coils adjacent in the axial direction or radius direction and a center line of the both coils is in a range of 45°±25°.

By using the shielding effect of the coil conductor against magentic flux, the coupling coefficient between the coils is raised.

At this time, if the primary coil and the secondary coil are combined such that they have an even number of windings in the axial direction or radius direction and, with respect to an insulating gap between both windings in a cross section of a diameter direction of the coils adjacent in the axial direction or radius direction, a line connecting a starting point and an end point of magnetic flux intersecting each coil is in a range of 45°±25° relative to the center line of both the coils, a horizontal factor in the diameter direction of magnetic flux intersecting each coil and a vertical factor in the coil center line direction intersecting the former come to intersect the conductor surface of each coil substantially perpendicularly. As a result, the conductor surface area perpendicular to the conductor increases so that the eddy current also increases, thereby producing a large shielding effect.

The surface effect of the conductor has been well known. The surface effect of the conductor refers to a phenomenon that a current in the conductor is concentrated on the surface corresponding to the frequency. The higher the frequency, the more current is concentrated. Further, the shallower from the surface, the larger density of current flowing in that portion is. For example, in case of alternating signal of 10 KHz, current is concentrated within about 0.5 mm from the conductor surface. Thus, if the depth is sufficient, the shielding effect of the conductor is intensified more as the conductor surface area perpendicular to the magnetic flux is increased.

On the other hand, to achieve the second object, in the isolation transformer of the present invention, the effective magnetic permeability of a magnetic circuit formed by the cores is reduced appropriately so as to stabilize the transmission efficiency. Further, in the isolation transformer of the present invention, by increasing magnetic resistance against leakage magnetic flux, the leakage magnetic flux is suppressed so as to intensity the electric energy transmission efficiency.

Particularly in the isolation transformer of the present invention, the position of a gap formed between the primary core and the secondary core is different from a position of a gap formed between the primary coil and the secondary coil. The aforementioned second object is achieved, for example, by disposing the primary coil and secondary coil at a position where they are wrapped by one of the primary core and secondary core, without a reduction of the gap.

Further, the other isolation transformer of the present invention comprises a ring-like shielding body made of a high conductivity material having a slit for interrupting a closed loop. For example, by providing the aforementioned ring-like shielding body in a direction intersecting the leakage magnetic flux between the coils, the leakage magnetic flux is reduced so as to achieve the second object.

In the other isolation transformer of the present invention, the position of a gap formed between the cores is different from the position of a gap formed between the coils and a ring-like shielding body is disposed to intersect a traveling direction of magnetic flux interlinking between the coils. As a result, a large current electric energy can be transmitted in a high efficiency.

Further, the present invention provides an isolation transformer comprising a primary core, a secondary core disposed to oppose the primary core via a predetermined gap, and primary coil and secondary coil attached to the primary core and secondary core respectively such that they are inductively coupled, wherein, of the primary core and the secondary core, one thereof is a disc like member having an outer peripheral wall on a peripheral edge while the other is a disc like member having a cylindrical portion to be disposed inside the outer peripheral wall in the center, and of the primary coil and the secondary coil, one thereof is disposed along an inside face of the outer peripheral wall of the one core while the other is disposed along an outside face of the cylindrical portion of the other core, and the position of a gap formed between the primary core and the secondary core is different from the position of a gap formed between the primary coil and the secondary coil.

To achieve the aforementioned third object, the present invention provides a transmission control apparatus including an isolation transformer comprising plural primary coils and plural secondary coils separately attached to the primary core and secondary core respectively such that they are inductively coupled, a high output signal transmission means connected to one primary coil of the primary coils and one secondary coil inductively coupled to that primary coil for transmitting the high output signal for igniting an air bag, and a low output signal transmission means connected to the other primary coil of the primary coils and the secondary coil inductively connected to that primary coil for transmitting low output signal for information transmission. For example, in case where the low output signal includes plural kinds of signals, the signal transmission circuit transmits each low output signal with a different resonant frequency to the isolation transformer.

That is, the power transmission system for transmitting from the column side to the air bag shot-firing circuit on the shaft side and the signal transmission system for transmitting from the shaft side to the column side are separated. As a result, the high output signal and low output signal can be transmitted at the same time via the isolation transformer connected to each transmission system, so that plural low output signals are transmitted, thereby achieving instantaneous air bag ignition and improving signal transmission efficiency.

On the other hand, preferably the transmission control apparatus comprises a plurality of the low output signal transmission means, the other primary coil and the other secondary coil each comprising plural coils corresponding to the number of the low output signal transmission means and being attached to the primary core and the secondary core separately such that they are inductively coupled with each other, the low output signal transmission means being connected to the corresponding primary coil and the secondary coil inductively coupled with the primary coil so that the low output signal is transmitted via the primary coil and secondary coil.

Preferably, the primary core and secondary core are formed of material having a different relative magnetic permeability depending on a use purpose of a signal to be transmitted through the plural primary coils and secondary coils.

Preferably, core of material having a high magnetic permeability is disposed in a path of interlinkage magnetic flux between the coils and a sectional area perpendicular to the interlinkage magnetic flux of the core is different depending on power level of the signal.

Here, in case of transmitting electric signal or electric power using the transformer, usually, the primary side and secondary side are distinguished depending on the transmission direction. That is, electric signal or electric power is transmitted from the primary side to the secondary side. However, in the isolation transformer of the present invention, interactive transmission can be considered as an object. Thus, for convenience of description in this specification, it is defined that a side of supplying a power is the primary side and a side of receiving the power is the secondary side based on the power transmission direction of the isolation transformer.

BEST MODE FOR CARRYING OUT THE INVENTION

Hereinafter, an example of the isolation transformer of the present invention for achieving the aforementioned first object will be described in detail with reference to FIGS. 1–9.

Figure 1:
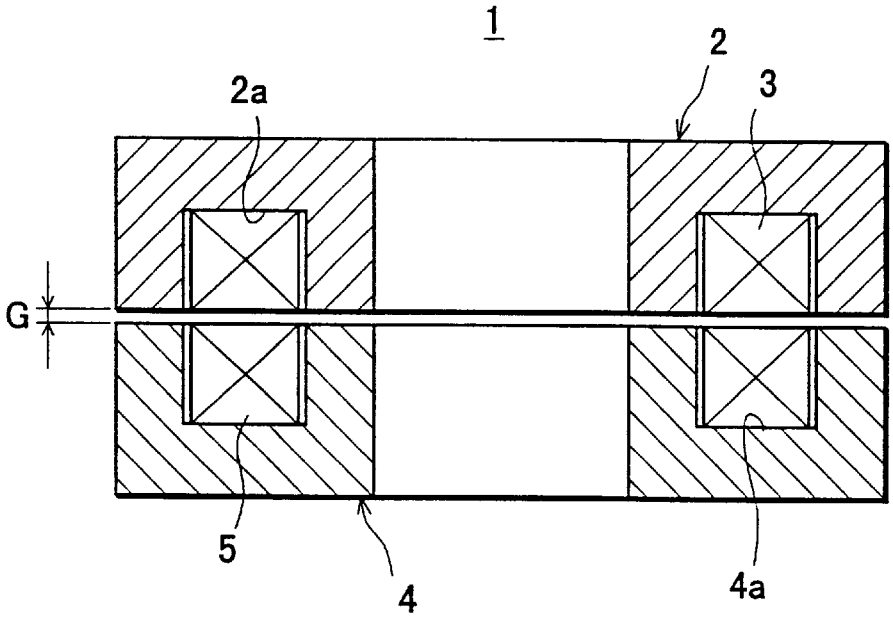
FIG. 1 is a front view showing a section of a rotary transformer according to an example of an isolation transformer of the present invention for achieving a first object.

In the isolation transformer 1, as shown in FIG. 1, cores 2, 4 are disposed to oppose each other such that they are relatively rotatable across a predetermined gap G and a primary coil 3 and a secondary coil 5 are accommodated in accommodation grooves 2*a*, 4*a* respectively formed in the cores 2, 4.

The cores 2, 4 are formed in a hollow cylindrical shape of magnetic material having a high relative magnetic permeability such as, for example, ferrite and the accommodation grooves 2*a*, 4*a* are formed on sides in which they are disposed so as to oppose each other.

Figure 4A:
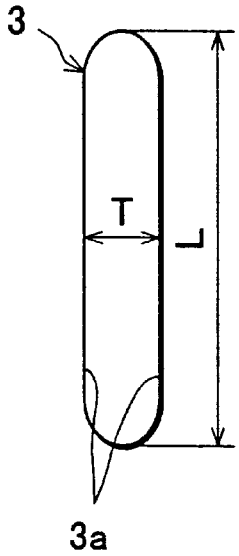
FIGS. 4A–4H are diagrams showing various sectional shapes of the primary coil and secondary coil.
Figure 4B:
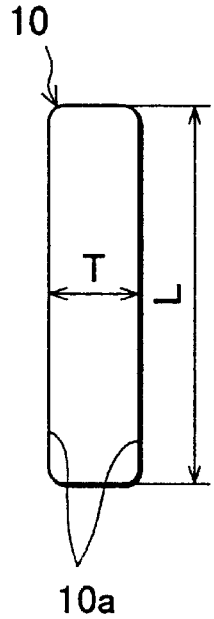
Figure 4C:
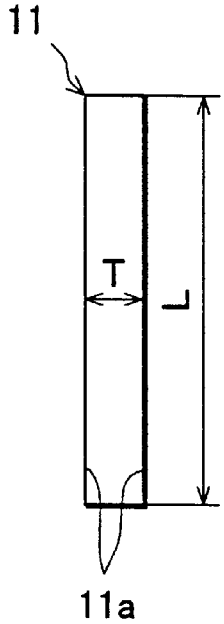
Figure 4D:
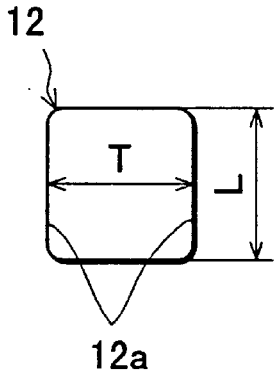
Figure 4E:
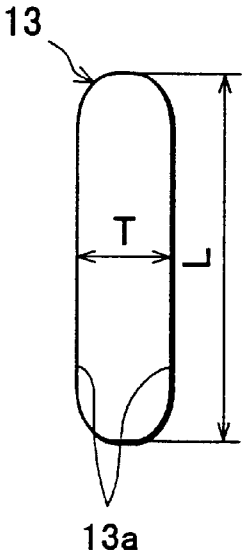
Figure 4F:
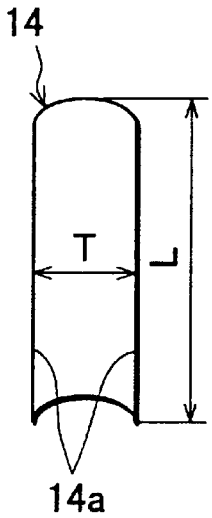
Figure 4G:
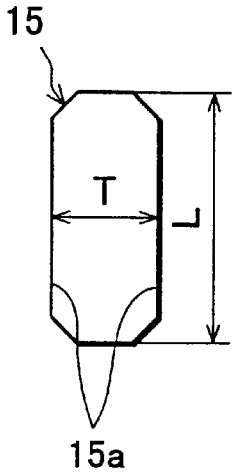
Figure 4H:
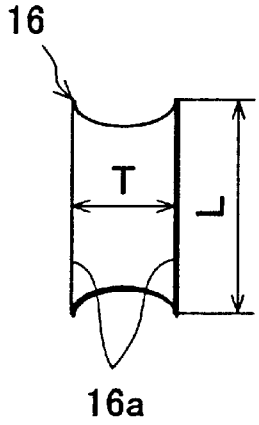

The primary coil 3 and secondary coil 5 each employ a rectangular wire. The rectangular wire mentioned here is, for example, like a primary coil 3 whose sectional shape is shown in FIG. 4A. In its sectional shape, it has at least two substantially parallel sides 3*a* while a length L of each of the substantially parallel two sides 3*a* is larger than that of a distance T between the two sides 3*a*. The secondary coil 5 is the same as this. Each of the coils 3, 5 is wound up in a condition such that the long side overlaps each other. In the primary coil 3 and secondary coil 5, the two sides only have to be substantially parallel to each other, but do not have to be absolutely parallel to each other.

As regards the isolation transformer 1 of the present invention having such a structure, a fundamental principle for improving the coupling condition between the coils will be described below.

In a rotary transformer shown in FIGS. 2A–2D, the winding number of each of the primary coil C1 and secondary coil C2 is two turns.

Figure 2A:
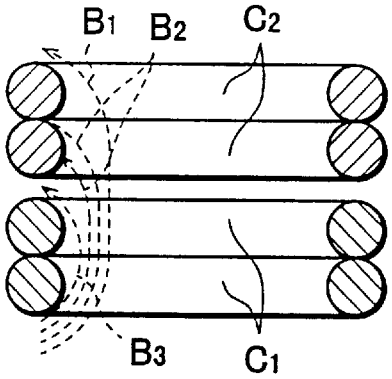
FIGS. 2A–2D are sectional views showing a shape and disposition of a primary coil and a secondary coil for use in the rotary transformer of FIG. 1.
Figure 2B:
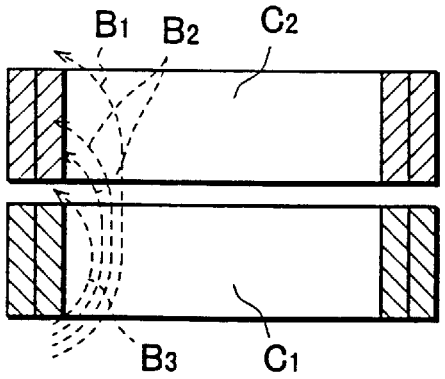
Figure 2C:
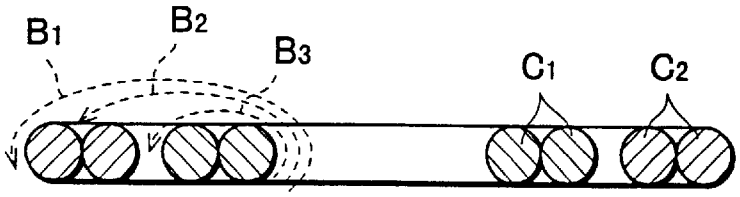
Figure 2D:
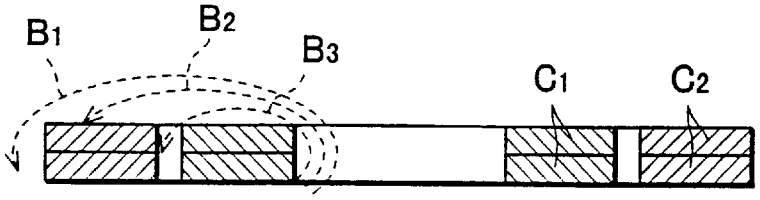

FIGS. 2A, 2B indicate a case in which both the coils C1, C2 are disposed so as to oppose each other, and FIGS. 2C, 2D indicate a case in which both the coils C1, C2 are disposed coaxially with each other. In FIGS. 2A, 2C, the sectional shape of the coil is round and in FIGS. 2B, 2D, the sectional shape of the coil is rectangular. In each case, the coils C1, C2 are disposed such that they are relatively rotatable across a gap.

In the coils C1, C2 whose section is shown in FIGS. 2A–2D, the insulating layer for covering a surface of a conductor is omitted to simplify graphical representation.

Theoretically, the coupling condition between the coils C1 and C2 can be judged quantitatively from an interlinkage of magnetic flux between the coils. That is, when alternate current flows in the primary coil C1, alternating magnetic flux occurs around the primary coil C1. The coupling condition between the coils $C_1$ and $C_2$ is determined depending on how this alternating magnetic flux interlinks with the secondary coil C2.

For example, it is assumed that the interlinkage magnetic flux B1 interlinking with the secondary coil C2 is large and the leakage magnetic flux B3 not interlinking with the secondary coil C2 is small, and then the larger the ratio R (B1/B3) between the interlinkage magnetic flux B1 and leakage magnetic flux B3, the better the coupling condition between the primary coil C1 and secondary coil C2 is. In the description made below, of the alternating magnetic flux which is generated by alternate current flowing in the primary coil C1 therearound, the magnetic flux crossing the conductor of the secondary coil C2 5 is called magnetic flux 82.

In the case where there is no core as shown in FIGS. 2A–2D, the quantity of magnetic flux of the interlinkage magnetic flux B1 and leakage magnetic flux B3 is determined depending on a relative position between the coils C1 and C2. However, the situation is different if the rotary transformer utilizes a core having a high relative magnetic permeability.

That is, magnetic resistance of a magnetic circuit formed by the core is much smaller than that of the air. Because the relative magnetic permeability of ferrite material is usually over several thousands, the magnetic resistance of the interlinkage magnetic flux B1 caused by the core is 1/several thousands. Therefore, following formulas are established.

$$B1>>(B2+B3)$$

$$B1/(B1+B2+B3)\approx 1$$

Therefore, in the rotary transformer using a core having a high relative magnetic permeability, the coupling condition between the primary coil C1 and secondary coil C2 is very excellent.

In the rotary transformer, magnetic resistance of the interlinkage magnetic flux B1 is increased rapidly if the gap between the cores is increased (from several micron m to several thousand micron m), because it is largely affected by the gap. Therefore, in the rotary transformer, as the gap is increased, the ratio between the interlinkage magnetic flux B1 and leakage magnetic flux B3 is decreased, so that the coupling condition between the primary coil C1 and secondary coil C2 is worsened.

Thus, in the isolation transformer of the present invention, the coupling condition between the coils is improved by using the shielding effect between the coils with respect to magnetic flux of a mate.

Referring to FIGS. 2A–2D, eddy current is generated by magnetic flux B2 crossing a conductor in the conductor of the secondary coil C2. Although the direction of alternating magnetic flux generated by this eddy current is opposite to the direction of magnetic flux B2, the interlinkage magnetic flux B1 and leakage magnetic flux B3 are in the same direction. Viewing equivalently, if the eddy current increases, the magnetic flux B2 crossing the conductor decreases while the interlinkage magnetic flux B1 and leakage magnetic flux B3 increases.

However, magnetic flux generated by the eddy current is interrupted by a conductor of the primary coil C1 when it joined in the leakage magnetic flux B3. As a result, an increment Δ B1 of the interlinkage magnetic flux B1 becomes larger than the increment ΔB3 of the leakage magnetic flux B3 (ΔB1>ΔB3) and the ratio between the interlinkage magnetic flux B1 and leakage magnetic flux B3 is increased, so that the coupling condition of the coils is improved. Therefore, in the rotary transformer, deterioration of the coupling condition between the coils C1 and C2 is largely suppressed by the shielding effect of the rectangular wire of the coil even if the gap is enlarged.

That is, the conductor generates a kind of shielding effect due to a kind of magnetic resistance relative to alternating magnetic field. Therefore, in the isolation transformer, as this shielding effect is increased, the coupling condition between the coils C1 and C2 is improved.

In the case of the coils C1, C2 using the rectangular wire as shown in FIGS. 2B, 2D, conductor resistance in a direction perpendicular to the magnetic flux is so small that eddy current flows easily. On the other hand, in the case of the coils C1, C2 using round wires as shown in FIGS. 2A, 2C, the conductor resistance in a direction of eddy current flow is so large and therefore, their shielding effect is far lower than the case of the rectangular wire. Particularly, if the winding number is small, part of a round wire goes into a gap between other round wires when a plurality of the round wires are stacked on each other, so that although the shielding effect is expected to be improved as compared to a case in which the winding layer is single, the effect is only improved slightly.

However, in the isolation transformer using coils of rectangular wire, the difference of the shielding effect is high. Further, if the winding number of the coils is reduced, the rectangular coil winding space can be reduced in the isolation transformer, so that the size thereof can be also reduced.

On the other hand, it is apparent that the degree of improvement of the coupling condition between the coils C1 and C2 relates to transmission frequency in the isolation transformer.

Figure 3:
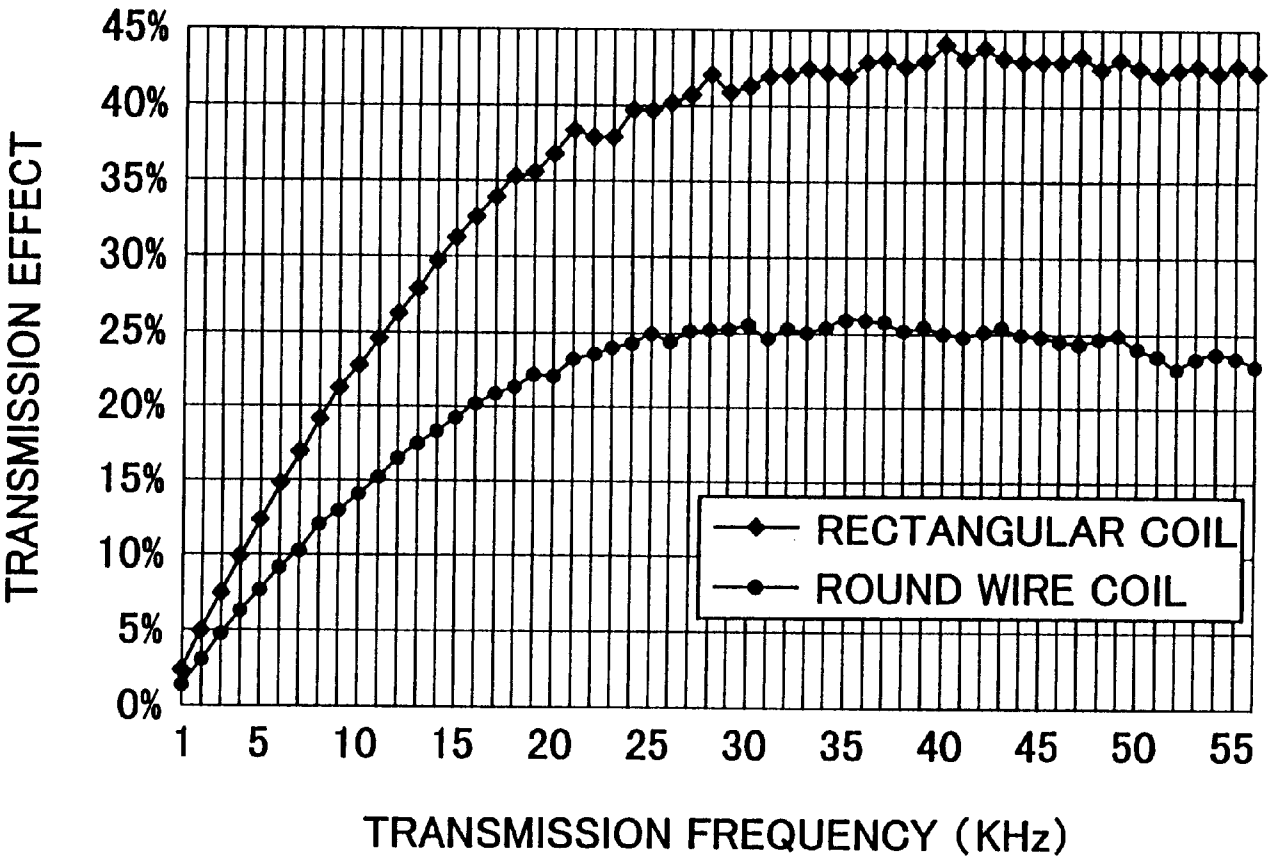
FIG. 3 is a transmission effect characteristic diagram for comparing the shielding effect of a rectangular coil with that of a round wire coil.

FIG. 3 shows a result of test for comparing the shielding effect of the rectangular wire coil with that of the round wire coil. In both the coils, it was assumed that the relative magnetic permeability of the core was about 100 and a gap between the cores is 1 mm. It was assumed that a load connected to the secondary coil was 1Ω pure resistance. As electric signal, a sine wave was used. It was assumed that the winding numbers of the primary side and secondary side were 2:2 and both the coils are disposed so as to oppose each other as shown in FIGS. 2A, 2B. Further, it was so set that the rectangular wire had a section of 2 mm×0.2 mm and the round wire had a section of 0.7 mm in diameter and that both the coils had a substantially same sectional area.

Then, the coupling condition between the coils was judged using transmission efficiency as a parameter. Although the relation between transmission efficiency and coupling coefficient between the coils is not simple, there is a quite strong correlation between the transmission efficiency and coupling coefficient if the same test condition is applied.

Transmission efficiency=(effective current value of secondary side×effective voltage)/(effective current value of primary side× effective voltage)

As shown in FIG. 3, the transmission efficiency of the rectangular wire is largely improved as compared to the transmission efficiency of the round wire irrespective of transmission frequency. Particularly, although it can be recognized that the round wire also has the shielding effect when the frequency is high, it is apparent that the shielding effect is as low as about ½ that of the rectangular wire.

However, production cost of a coil in which the sectional shape of its conductor is accurately rectangular as shown in FIGS. 2B, 2D is practically high. Then, practical coils whose production costs are cheap although the improvement of the shielding effect is slightly lower than that of a case in which the sectional shape is accurately rectangular, are exemplified in FIGS. 4A–4H as coil 3 and 10–16.

These coils mainly intend to minimize insulation space between conductors in each turn of the coil so as to enhance the shielding effect relative to leakage magnetic flux between the coils. Therefore, for both the coils C1, C2, corresponding to production cost and wire winding space thereof, the sectional shape of the conductor is selected from FIGS. 4A–4H appropriately.

Figure 5A:
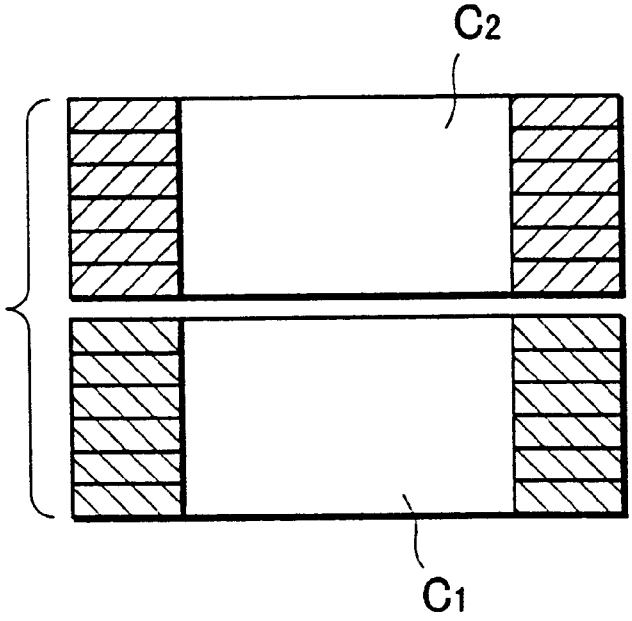
FIGS. 5A, 5B are sectional views showing other shape and disposition of the primary coil and secondary coil for use in the rotary transformer of FIG. 1.

Further, the primary coil C1 and secondary coil C2 are not restricted to the opposing disposition as shown in FIG. 2B and coaxial disposition as shown in FIG. 2D as long as they are wound in a condition that substantially parallel two long sides overlaps each other. For example, in the primary coil C1 and secondary coil C2, as shown in FIG. 5A, they are wound in a condition that substantially parallel two long sides overlap each other vertically and then they are disposed so as to oppose each other. In the primary coil C1 and secondary coil C2 as shown in FIG. 5B, they are wound in a condition that substantially parallel two long sides are placed vertically and then the two coils are disposed coaxially with each other.

Figure 5B:
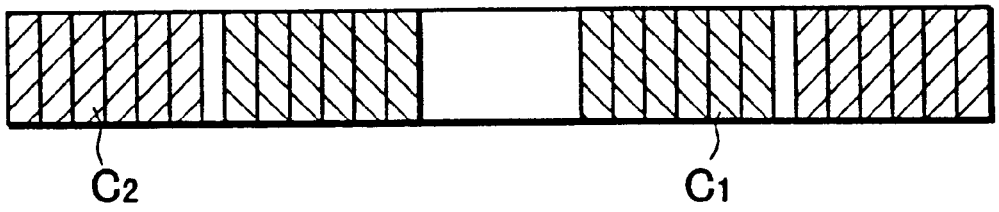

In the coils C1, C2 shown in FIGS. 5A, 5B also, the insulating layer for covering the surface of the conductor is omitted to simplify the graphical representation like the coils C1, C2 shown in FIGS. 2A–2D.

Generally, the eddy current is inclined to be concentrated on the surface of conductor depending on magnetic flux frequency. The shielding effect of the conductor is increased as the surface area of the conductor perpendicular to the magnetic flux B2 crossing the conductor is increased. In case of the coils C1, C2 formed by winding the rectangular wire as described in FIGS. 2B, 2D, because the surface area of the conductor perpendicular to the magnetic flux is large, the eddy current increases.

Figure 6:
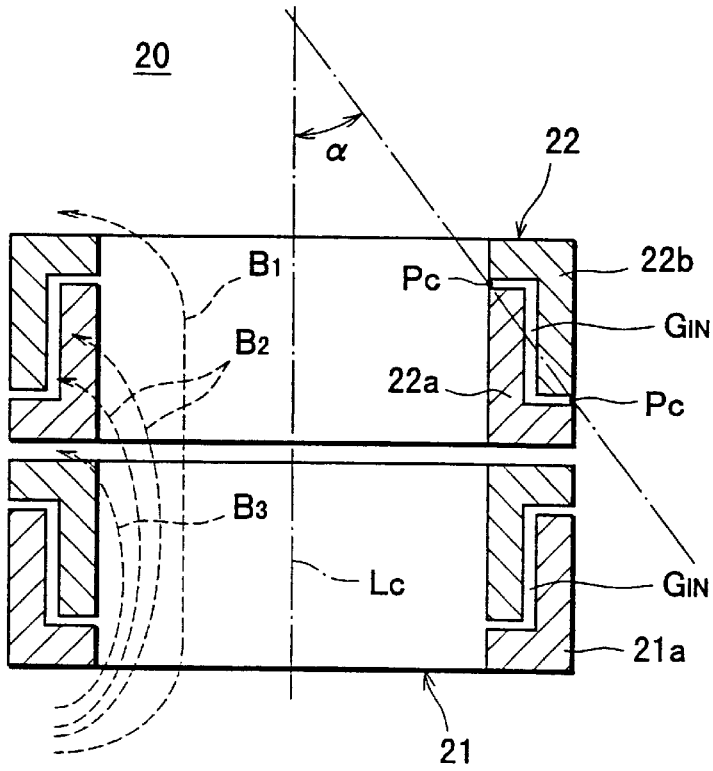
FIG. 6 is a sectional view of the rotary transformer according to a second example.

As an isolation transformer according to a second example of the present invention, a rotary transformer as shown in FIG. 6 is provided, in which its primary coil 21 and secondary coil 22 are formed each of an exemplified coil.

Because the primary coil 21 and secondary coil 22 are of the same shape, the secondary coil 22 will be described and a description of the primary coil 21 is omitted by attaching reference numerals corresponding in the Figure.

The secondary coil 22 comprises two windings, that is, windings 22*a*, 22*b* and these windings are constructed with an insulating gap GIN in a cross section in the diameter direction between the winding 22*a* and 22*b*, so that a sharp angle α between a line LB connecting centers PC on both ends of the insulating gap GIN and a center line LC of both the coils 21, 22 is substantially 50°. Here, the sharp angle α may be in a range of 45°±25°.

In the rotary transformer 20 using the primary coil 21 and secondary coil 22 having such a structure, of alternating magnetic flux generated when alternating current flows in the primary coil 21, magnetic flux B2 crossing the windings 22*a*, 22*b* in the secondary coil 22 is divided to horizontal factor BH and vertical factor BV for analysis.

Figure 7:
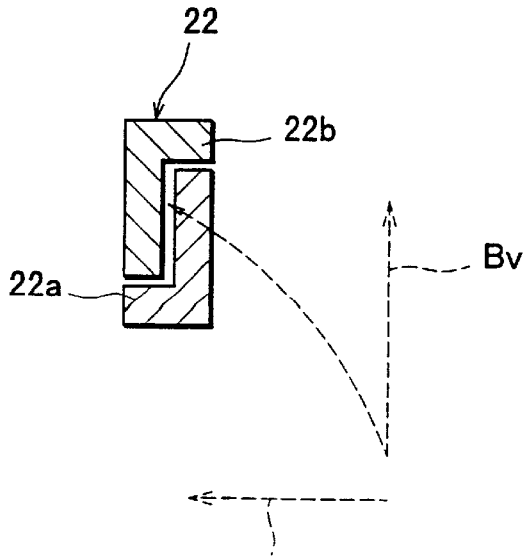
FIG. 7 is a model diagram showing a horizontal factor and a vertical factor of magnetic flux intersecting a conductor in a coil constituting the rotary transformer of FIG. 6.

In case of the coils C1, C2 in which the rectangular wire are wound, it is apparent from FIG. 2B that although the shielding effect is generated with respect to the horizontal factor BH of the magnetic flux B2 shown in FIG. 7 crossing the conductor so that the eddy current is large, a sectional area of the conductor with respect to the vertical factor BV is small so that the eddy current is small. Therefore, in case of the coils C1, C2 composed of the rectangular wire, if the gap between the conductors is large, a possibility that the alternating magnetic flux passes through the insulating gap between the conductors to become leakage magnetic flux (partially interlinking) becomes large so that the coupling condition between the coils is worsened.

In the secondary coil 22, the windings 22*a* and 22*b* are combined such that the sharp angle α between the line LB connecting the centers PC on both ends of the insulation gap GIN and the center line LC of both the coils 21, 22 is substantially 50°. Therefore, a coil having a special shape as shown in FIG. 6 has a large shielding conductor area corresponding to the horizontal factor BH and vertical factor BV of the magnetic flux B2 even if the insulating gap GIN between the conductors is increased, so that a drop of the coupling condition due to the increased insulating gap can be further suppressed.

Therefore, for example, the coil having such a special shape can be produced easily in the following manner.

Figure 8A:
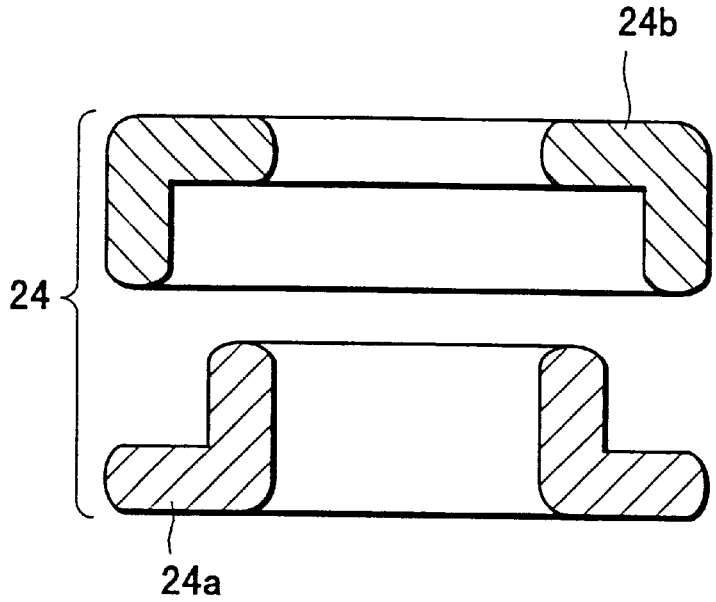
FIGS. 8A–8C are process diagrams showing a production process for the rotary transformer according to the second example.

First, a ring-like winding made of two kinds of conductors having a predetermined cross section is formed by pressing and an insulating slit is formed at a position in the peripheral direction thereof. Then, as shown in FIG. 8A, the windings 24*a*, 24*b* are disposed so as to oppose each other.

Figure 8B:
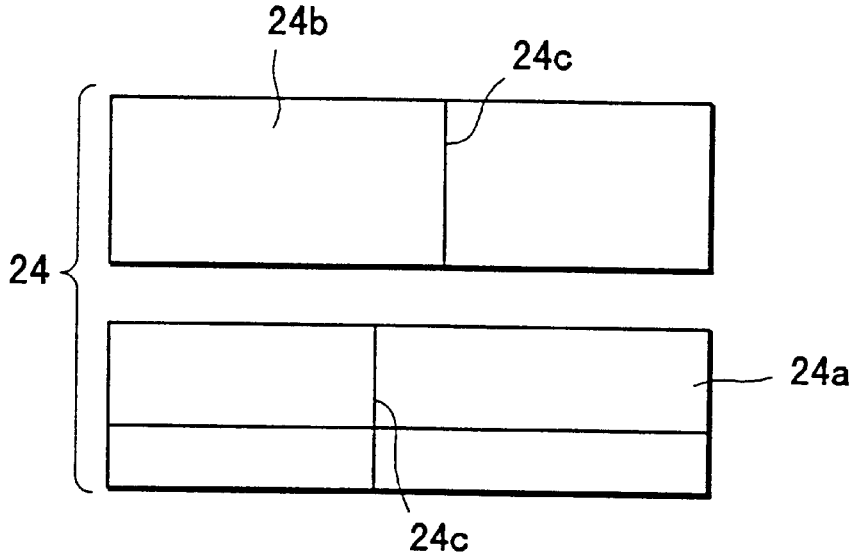

Next, as shown in FIG. 8B, the windings 24*a*, 24*b* are disposed so as to oppose each other near the insulating slit 24*c*.

Figure 8C:
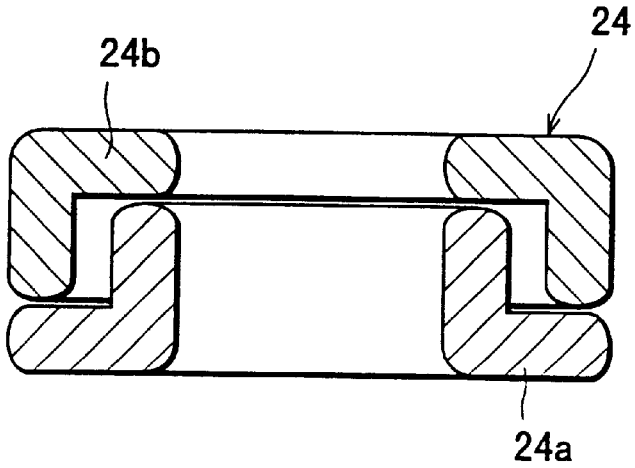
Figure 9A:
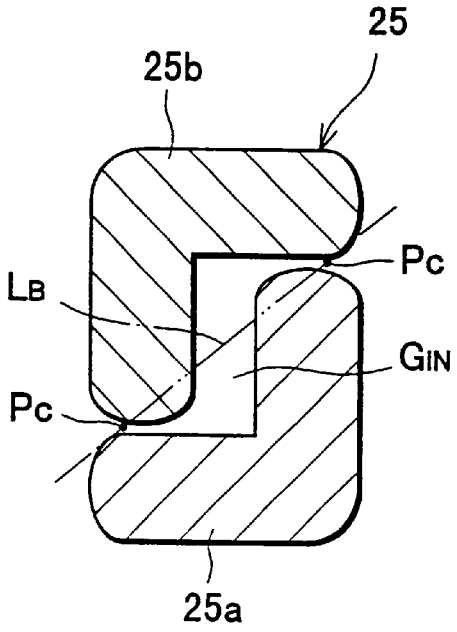
FIGS. 9A–9D are sectional views showing other shape of the coil for use in the second example.
Figure 9B:
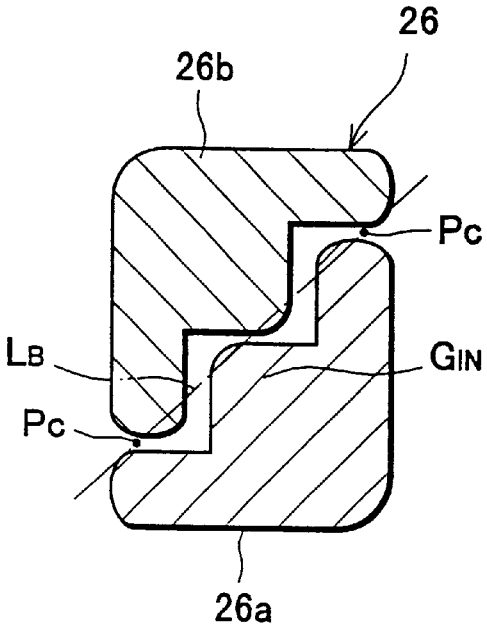
Figure 9C:
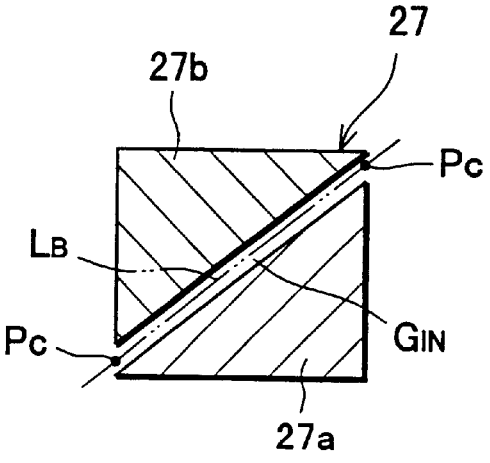
Figure 9D:
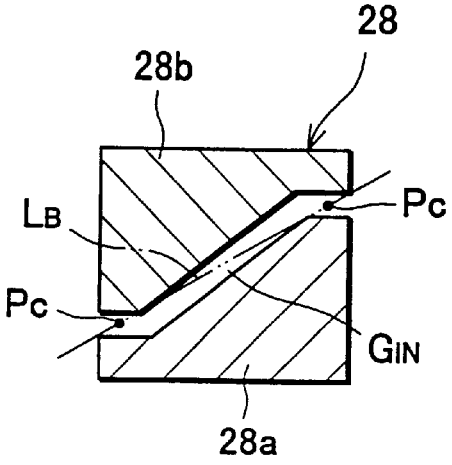

Next, insulating spacers (not shown) are disposed at necessary positions and as shown in FIG. 8C, the windings 24*a*, 24*b* are put together. They are welded to each other near each insulating slit 24*c* so as to form the coil 24 having the two windings 24*a*, 24*b* each having a turn.

The isolation transformer according to the second example has an even number of the windings in the axial direction or radius direction. If the sharp angle α formed by the line LB connecting the centers PC on both ends of the insulating gap GIN between the windings 22*a* and 22*b* in a cross section in the diameter direction of the coils adjacent in the axial direction or radius direction and the center line LC of the coils 21, 22 is in a range of 45°±25°, various kinds of the coils can be formed like coils 25–28 shown in FIGS. 9A–9D.

In the rotary transformer of the present invention, its transmission efficiency in transmitting electric energy of high-speed large-volume is not only improved by the improvement of the coupling condition between the coils, but also in case of transmission of high frequency signal as well, the reliability of signal transmission is improved by the improvement of the coupling condition.

The isolation transformer of the present invention is not restricted to the rotary transformer, but it is needless to say that it is applicable to any types as long as mating transformer cores are disposed so as to oppose each other such that there is a gap between the primary coil and secondary coil. For example, the isolation transformer of the present invention may be applied to a case in which the transformer cores are disposed so that they can be relatively moved so as to change the gap between the both, a case in which at least one transformer core is disposed around an axis so that it is rotatable or a case in which both the transformer cores are disposed such that they are fixed via a gap.

Next, an example of the isolation transformer of the present invention for achieving the aforementioned second object will be described with reference to FIGS. 10–21.

Figure 10:
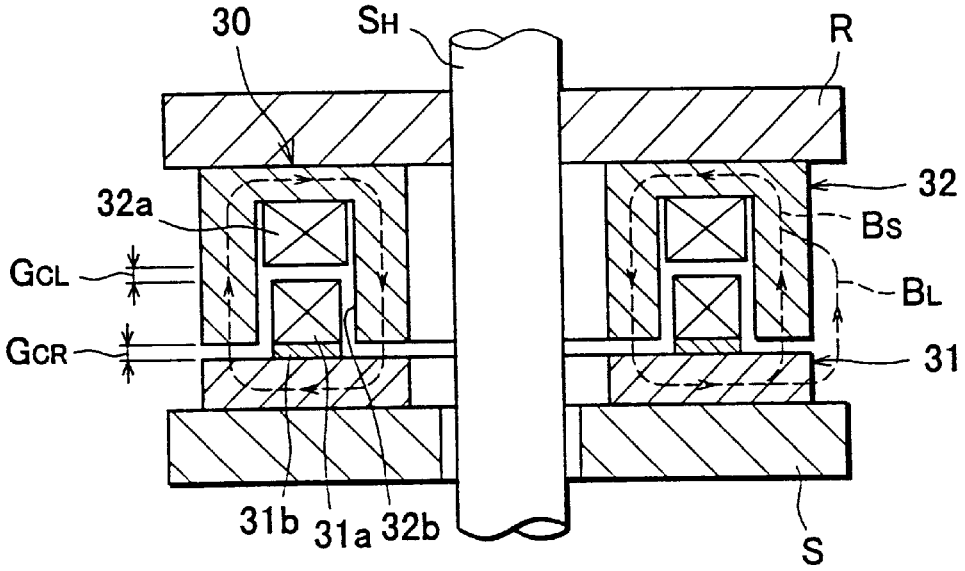
FIG. 10 is a schematic structural diagram of a third example of the isolation transformer for achieving a second object of the present invention.

FIG. 10 is a diagram showing a schematic structure of an isolation transformer 30 according to a third example. The isolation transformer 30 is assembled by providing a stator S on a fixed body (not shown) side and a rotor R installed on a rotation shaft $S_H$ with a primary core 31 and a secondary core 32 respectively. In the isolation transformer 30, the primary core 31 is of a disc shape and the secondary core 32 is thick and has an annular concave portion 32*b* deep enough for accommodating a primary coil 31*a* and a secondary coil 32*a* at the same time. In the isolation transformer 30, the primary coil 31*a* is mounted on a top surface of the primary core 31 via an auxiliary core 31*b* of ferrite having a high magnetic permeability and the secondary coil 32*a* is mounted in the concave portion 32*b* of the secondary core 32. Then, the primary coil 31*a* is disposed in the concave portion 32*b* so that both the coils 31*a* and 32*a* oppose each other via a predetermined gap $G_{CL}$ within the concave portion 32*b*.

That is, in the isolation transformer 30, the primary coil 31*a* mounted on the primary core 31 is disposed to oppose the secondary coil 32*a* within the concave portion 32*b* of the secondary core 32 via a predetermined gap $G_{CL}$ and on the other hand, the primary core 31 is disposed to oppose the secondary core 32 via a predetermined gap $G_{CR}$ provided around the primary coil 31*a*. In the isolation transformer 30 having such a structure, the position of the gap $G_{CR}$ formed between the cores 31 and 32 is different from the position of the gap $G_{CL}$ formed between the coils 31*a* and 32*a* in the axial direction.

In the isolation transformer 30 having such a structure, the position of the gap $G_{CR}$ between the cores 31 and 32 is deviated from the position of the gap $G_{CL}$ between the coils 31*a* and 32*a* substantially by a height (length) of the primary coil 31*a*.

Because in the isolation transformer having a conventional structure, the gap formed between the cores is at the same position as the gap formed between the coils, leakage magnetic flux generated in a gap between the cores passes through a gap between the coils. Therefore, to increase transmission efficiency, it was necessary to reduce that gap as much as possible so as to reduce leakage magnetic flux passing through the gap formed between the coils.

In this structure, the leakage magnetic flux $B_L$ interlinks with the secondary coil 32*a*, so that even if the gap $G_{CR}$ between the cores 31 and 32 is large, the leakage magnetic flux $B_L$ passing through the gap $G_{CL}$ between the coils 31*a* and 32*a* is small and therefore, that leakage magnetic flux $B_L$ interlinks with the secondary coil 32*a* so as to achieve magnetic coupling. Thus, the coupling efficiency between the primary coil 31*a* and secondary coil 32*a* can be increased sufficiently. Here, symbol BS in the Figure indicates interlinkage magnetic flux between the coils.

Particularly in the isolation transformer 30, the primary coil 31*a* and secondary coil 32*a* share a magnetic circuit (magnetic path) and the secondary coil 32*a* interlinks with the leakage magnetic flux $B_L$. Therefore, in the isolation transformer 30, in case where the gap $G_{CR}$ between the cores 31 and 32 is large, a change rate of the magnetic resistance of the aforementioned interlinkage magnetic flux is substantially the same as that of the magnetic resistance of the leakage magnetic flux, and therefore, worsening of the coupling condition between the coils can be reduced as compared to the conventional structure.

Therefore, in the isolation transformer 30, by increasing the gap $G_{CR}$ between the cores 31 and 32 to some extent, inductance in each of the coils 31*a*, 32*a* can be reduced. Therefore, the isolation transformer 30 is capable of transmitting a large current electric energy effectively without increasing the voltage by, for example, a boosting circuit. Further, because in the isolation transformer 30, the gap $G_{CR}$ can be set to a large value, an influence of gap deflection relative to external factors such as vibration and heat can be suppressed, so that a stable electric energy transmission can be achieved.

Further, according to the above described structure, the isolation transformer 30 is capable of largely relaxing an allowable range in the size of the gap $G_{CR}$. Therefore, the isolation transformer 30 is capable of relaxing the production accuracy of the cores 31, 32 and coils 31*a*, 32*a* and further assembly precision, thereby production cost thereof can be largely reduced. Further, because as described above, the isolation transformer 30 is capable of suppressing inductance of the coil, voltage level necessary for a large current electric energy transmission can be suppressed and an expensive boosting circuit is not needed.

Figure 11:
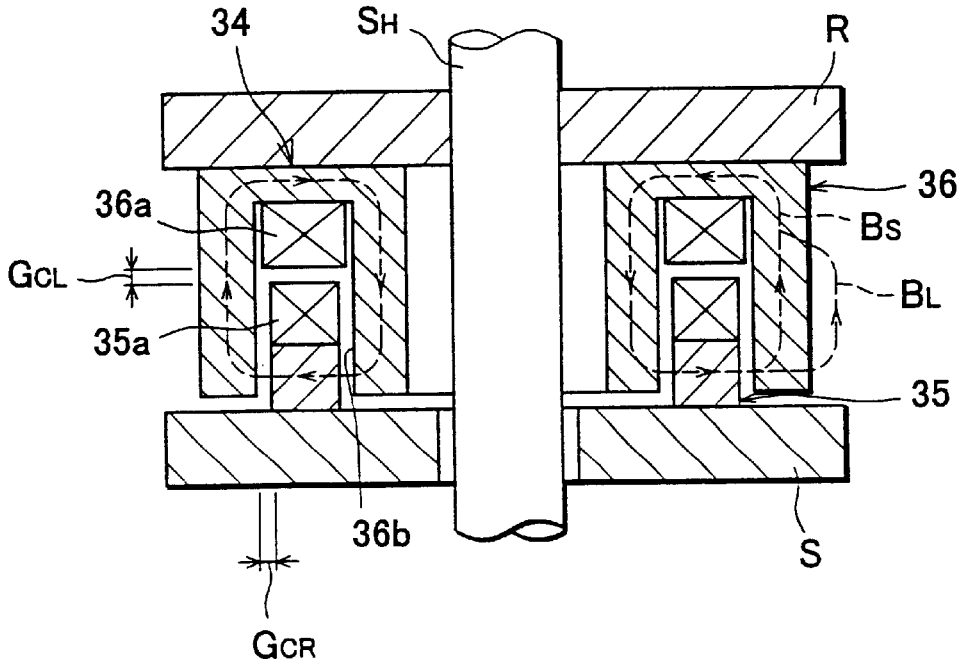
FIG. 11 is a schematic structural diagram of the isolation transformer according to a fourth example.

FIG. 11 is a diagram showing a schematic structure of the isolation transformer 34 according to a fourth example.

In the isolation transformer 34, its secondary core 36 is further thickened and its concave portion 36*b* is deep enough for accommodating a primary core 35 as well. The primary core 35 is accommodated in the concave portion 36*b* and there is formed a gap $G_{CR}$ vertically between the primary core 35 and secondary core 36. That is, the isolation transformer 34 is so constructed as to accommodate the primary core 35 as well as the primary coil 35*a* and secondary coil 36*a* within the concave portion 36*b* provided in the secondary core 36.

In the isolation transformer 34 having such a structure, the leakage magnetic flux $B_L$ generated in the gap $G_{CR}$ interlinks with the secondary coil 36*a* more strongly than the isolation transformer 30 having the structure shown in FIG. 10. That is, in the isolation transformer 34, a direction of the gap $G_{CR}$ between the cores 35 and 36 intersects with a direction of the gap $G_{CL}$ between the coils 35*a* and 36*a*. As a result, the isolation transformer 34 is capable of making the leakage magnetic flux $B_L$ interlink with the secondary coil 36*a* more securely so that electric energy transmission efficiency can be further increased.

Figure 12:
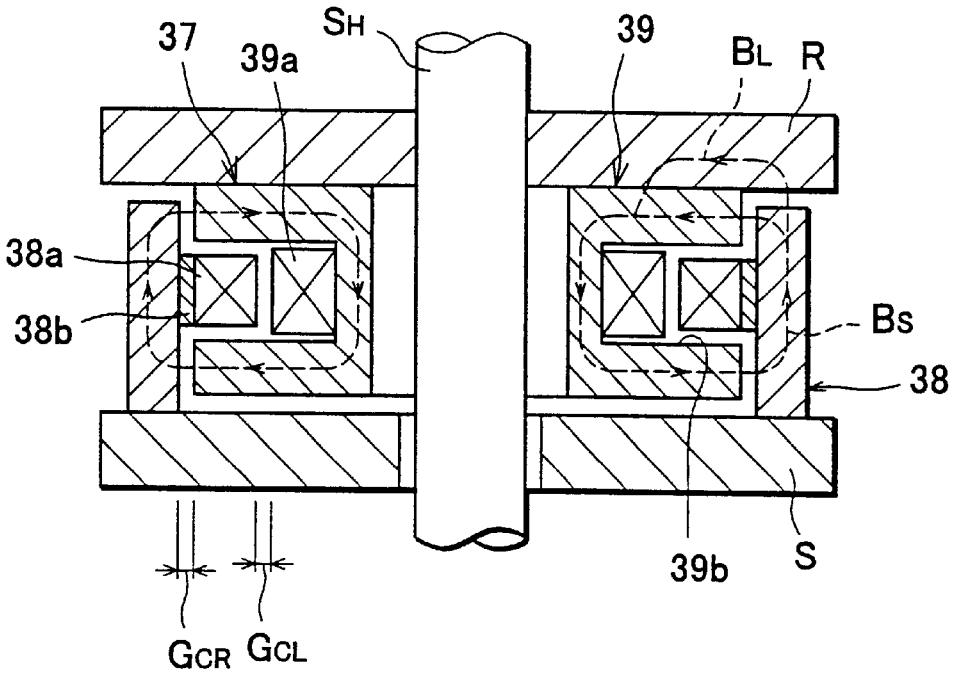
FIG. 12 is a schematic structural diagram of the isolation transformer according to a fifth example.

Further, an isolation transformer as shown in FIG. 12 can be achieved by disposing a primary core 38 and a secondary core 39 coaxially so as to oppose each other. In the fifth example, the primary core 38 is formed in a cylindrical shape and a secondary core 39 is disposed inside thereof via a predetermined gap $G_{CR}$. A concave portion 39*b* is formed in the peripheral face of the secondary core 39 and then, a primary coil 38*a* and a secondary coil 39*a* are disposed so as to oppose each other via a gap $G_{CL}$ inside thereof. At this time, the primary coil 38*a* is attached to the inside face of the primary core 38 via an auxiliary core 38*b* made of ferrite having a high magnetic permeability.

In the isolation transformer 37 having such a vertically opposing structure, by setting a position of the gap $G_{CR}$ formed between the cores 38 and 39 at a different position from a position of the gap $G_{CL}$ formed between the coils 38*a* in plane basis, and 39*a*, the same effect as the above described examples can be obtained. Particularly in this structure, a distance between the stator S and rotor R can be reduced because the coils 38*a*, 39*a* are disposed in the diameter direction, and therefore this is favorable for thinning the structure of the isolation transformer 37.

In the above described respective examples, the position of the gap $G_{CR}$ formed between the cores is set to a different position from the position of the gap $G_{CL}$ formed between the coils in plane basis. Additionally, there is a valid effect also if the magnetic resistance of a leakage magnetic circuit formed including the gap $G_{CL}$ is increased.

Figure 13:
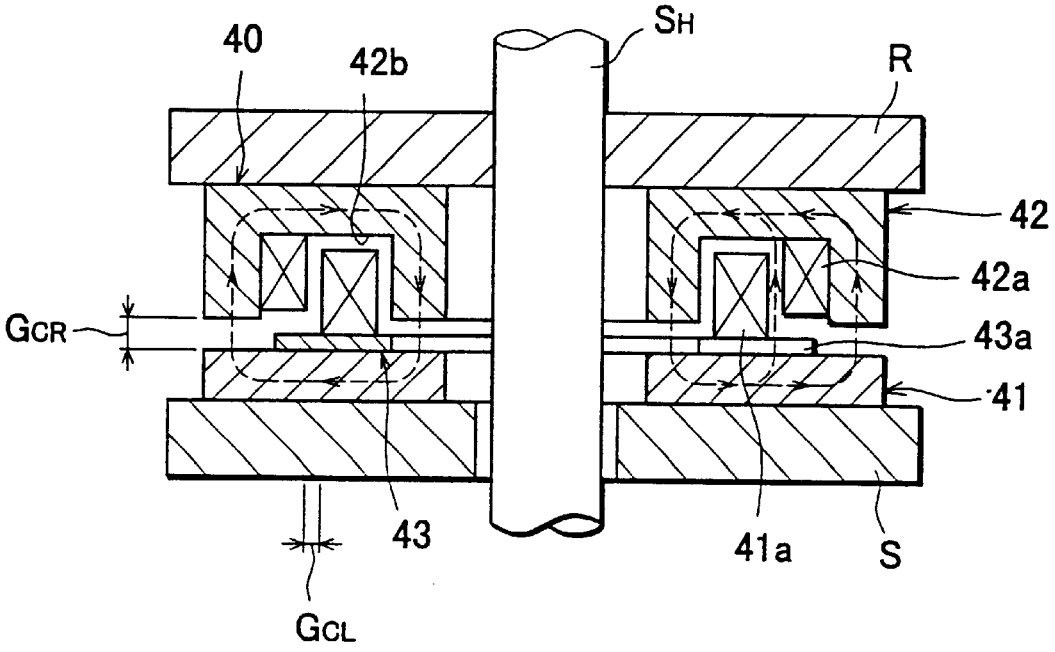
FIG. 13 is a schematic structural diagram of the isolation transformer according to a sixth example.

FIG. 13 is a diagram showing a schematic structure of an isolation transformer 40 according to a sixth example which is achieved on such a viewpoint.

A structure of the isolation transformer 40 will be described. The feature thereof is that a ring-like shielding body 43 made of, for example, a high conductivity material such as copper is provided between a primary core 41 and a primary coil 41*a* mounted thereon.

Figure 14:
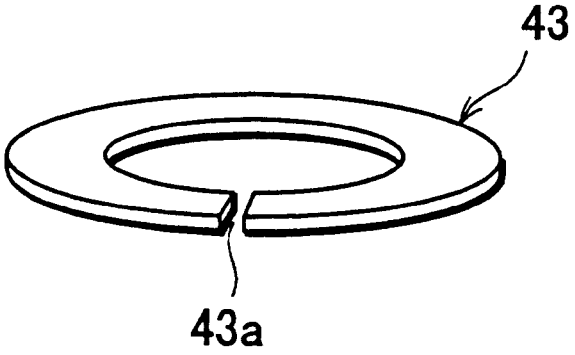
FIG. 14 is a perspective view showing a structure of a ring-like shielding body to be incorporated in the isolation transformer having a structure shown in FIG. 13.
Figure 15:
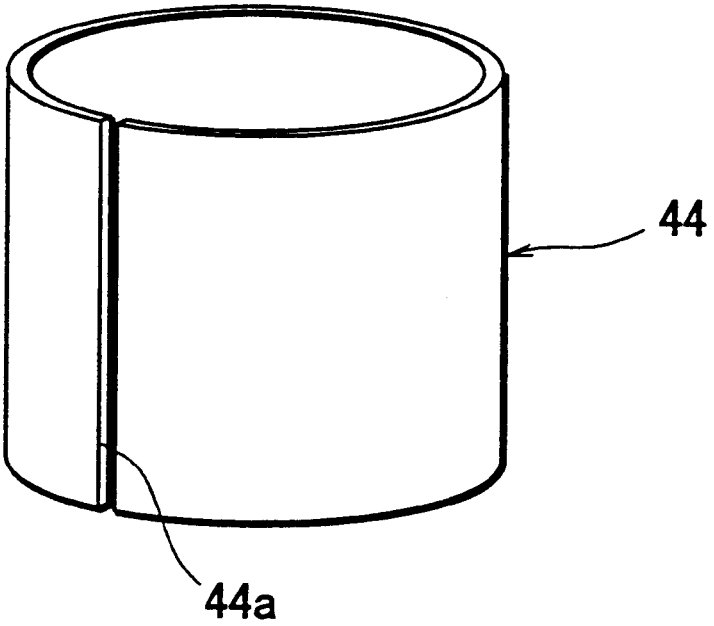
FIG. 15 is a perspective view showing a structure of a cylindrical shielding body.
Figure 16:
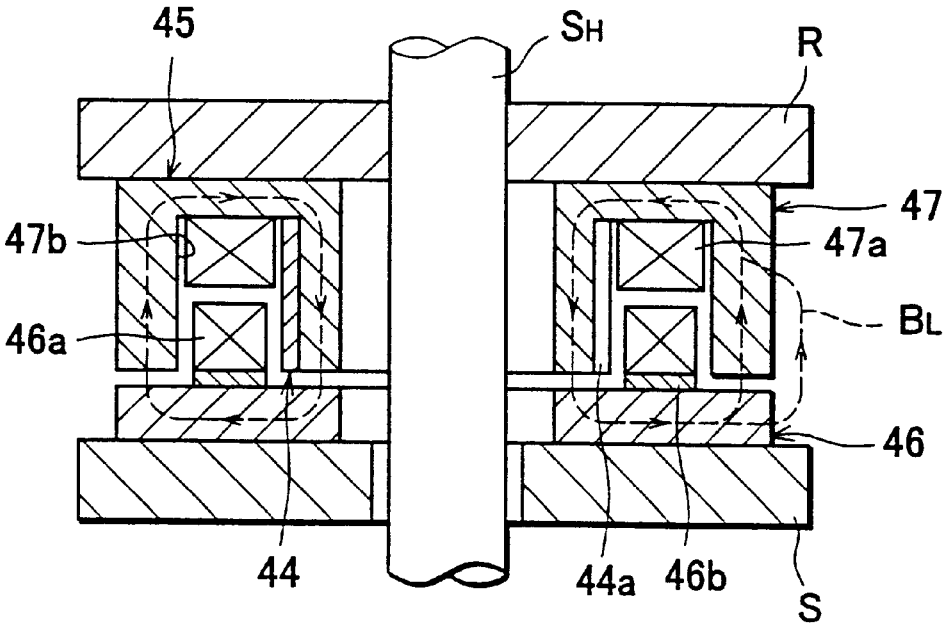
FIG. 16 is a schematic structural diagram of the isolation transformer according to a seventh example.

The shielding body 43, for example as shown in FIG. 14, has a slit 43*a* for preventing a formation of electric closed loop by cutting the ring in the peripheral direction and functions as a shielding object against magnetic flux.

On the other hand, the primary coil 41*a* is mounted on the shielding body 43 and disposed in a concave portion 42*b* formed in a secondary core 42 such that it opposes a secondary coil 42*a* via a predetermined gap $G_{CL}$ in the radius direction. The secondary core 42 has a wide concave portion 42*b*. The secondary coil 42*a* is mounted on an outward periphery thereof inside and the primary coil 41*a* is accommodated therein such that it is located inside relative to the secondary coil 42*a*.

In the isolation transformer 40 having such a structure, the shielding body 43 is disposed vertically relative to a magnetic circuit (direction of leakage magnetic flux) of the leakage magnetic flux formed in the coils 41*a*, 42*a* so that it intersects with the leakage magnetic flux $B_L$. Thus, the shielding body 43 provides an operation of increasing the magnetic resistance relative to the leakage magnetic flux $B_L$. That is, when the leakage magnetic flux $B_L$ passes the shielding body 43, eddy current is induced in the shielding body 43. The magnetic field produced by this eddy current is opposite to the leakage magnetic flux $B_L$, operating as a large magnetic resistance. As a result, in the isolation transformer 40, apparently, the leakage magnetic flux $B_L$ passing the shielding body 43 largely decreases so that magnetic flux passing a main magnetic path produced by the cores 41, 42 increases thereby the coupling efficiency being raised. In other words, the shielding body 43 acts as a kind of magnetic resistance so as to suppress leakage magnetic flux density thereby further exerting an effect of suppressing the leakage magnetic flux itself.

Therefore, even if the gap. $G_{CR}$ between the cores 41 and 42 is enlarged so that magnetic resistance of a main magnetic circuit formed by the cores 41, 42 is increased, that is, an equivalent magnetic permeability of the main magnetic circuit is decreased, the leakage magnetic circuit is provided with the shielding body 43 having a large magnetic resistance.

Therefore, the isolation transformer 40 is capable of suppressing magnetic flux flowing into the leakage magnetic circuit and instead, increasing magnetic flux flowing in the main magnetic circuit thereby intensifying magnetic flux interlinking with the secondary coil 42*a*. That is, the isolation transformer 40 is capable of intensifying the coupling efficiency between the coils 41*a* and 42*a* thereby increasing electric energy transmission efficiency.

Further, as described previously, the position of the gap $G_{CR}$ formed between the cores 41 and 42 is different from the position of the gap $G_{CL}$ formed between the coils 41*a* and 42*a*. The isolation transformer 40 is capable of exerting a higher effect than the above described respective examples because the leakage magnetic flux can be suppressed thereby. Particularly, because the isolation transformer 40 is capable of suppressing leakage magnetic flux with such a simple structure as by raising magnetic resistance by providing with the shielding body 43, there is an effect that the dimensional allowable range relative to the gap $G_{CR}$ can be increased.

Here, a slit 43*a* prevents the shielding body 43 from acting as a 1-turn coil, thereby taking an important role in achieving a function of magnetic resistance. If the slit 43*a* does not exist, the shielding body 43 acts as a 1-turn coil so that conversely it acts to suppress a change in the magnetic flux within the coils 41*a*, 42*a*. Therefore, the slit 43*a* has only to be provided to prevent a formation of a closed loop in the shielding body 43 and the quantity and forming position thereof are not restricted.

The structure of the shielding body 43 is not restricted to a disc type shown in FIG. 14. That is, the shielding body may be formed in a cylindrical shape having a slit 44*a* in the peripheral wall, like a shielding body 44 shown in FIG. 15 and then installed within an isolation transformer 45 shown in FIG. 16 according to a seventh example of the present invention, such that it is disposed along an inner wall of a concave portion 47*b* of a core 47. The isolation transformer 45 having such a structure is capable of exerting the same effect as the aforementioned sixth example.

Here, the isolation transformer 45 has a substantially same structure as the isolation transformer 30 according to the third example shown in FIG. 10 except that the shielding body 44 is incorporated. Therefore, corresponding reference numerals are attached to components corresponding to the isolation transformer 30 and a detailed description of the isolation transformer 45 is omitted.

In the isolation transformer 45, a primary core 46 and a secondary core 47 are disposed so as to oppose each other via the gap $G_{CR}$ and the position of the gap $G_{CL}$ formed between the primary coil 46*a* and secondary coil 47*a* is different therefrom.

Figure 17:
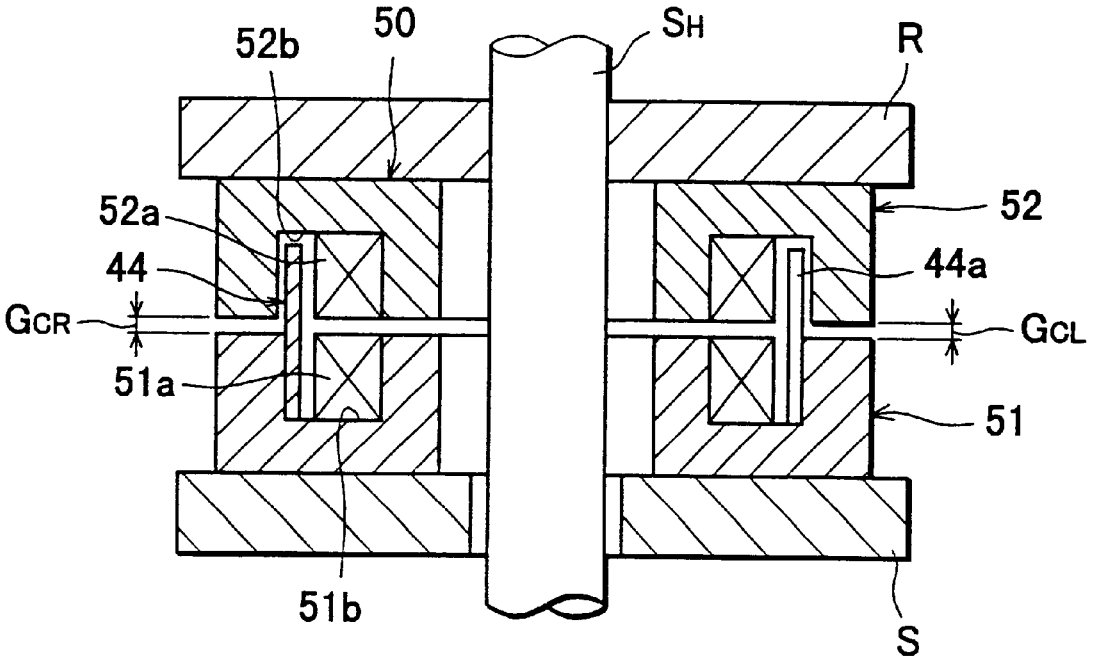
FIG. 17 is a schematic structural diagram of the isolation transformer according to an eighth example.

As shown in FIG. 17, the shielding body 44 may be incorporated in an isolation transformer 50 of a conventional plane opposing structure in which the gap $G_{CR}$ formed between the cores 51 and 52 is at the same position as the gap $G_{CL}$ formed between the coils 51*a* and 52*a*. The shielding body 44 is provided along outward walls of concave portions 51*b*, 52*b* in cores 51, 52.

In this case, although the isolation transformer 50 cannot be expected to achieve an effect of leakage magnetic flux suppression which is induced if the position of the gap $G_{CR}$ is different from the position of the gap $G_{CL}$, the effect of the leakage magnetic flux suppression by the shielding body 44 can be expected.

An isolation transformer according to a ninth example will be described with reference to FIG. 18.

In the isolation transformer 55, a primary core 56 and a secondary core 57 are disposed so as to oppose each other via a gap $G_{CR}$. A primary coil 56*c* and a secondary coil 57*c* are disposed on the cores 56, 57 respectively via a gap $G_{CL}$ such that they are inductively coupled with each other.

Here, the primary core 56 is fixed to the stator S and the secondary core 57 is fixed to the rotor R mounted on the rotation shaft $S_H$.

The primary core 56 is formed in a disc shape of soft magnetic material like soft magnetic ferrite sintered material and has an insertion hole 56*a* in the center and a peripheral wall 56*b* on a peripheral edge thereof.

The secondary core 57 is formed in a disc shape of soft magnetic material like soft magnetic ferrite sintered material and an insertion hole 57*b* is formed by a cylindrical portion 57*a* provided in the center thereof.

The primary coil 56*c* and secondary coil 57*c* are formed by winding wires at required turns depending on a use purpose of the transformer, having a rectangular cross section and in an annular shape entirely having a predetermined inside diameter. At this time, a conductor of the wire is covered with polyurethane base insulating film and polyamide base fusion film is coated the reover. By heating, the aforementioned fusion film is fused with another fusion film so as to maintain a coil configuration.

The primary coil 56*c* is disposed inside an outer peripheral wall 56*b* of the primary core 56 and the secondary coil 57*c* is disposed outside a cylindrical portion 57*a* of the secondary core 57.

The isolation transformer 55 having such a structure was produced in the following manner.

First, wire was wound at required turns corresponding to a use purpose of the transformer so as to form the primary coil 56*c*.

Then, the obtained primary coil 56*c* was subjected to a processing in which its fusion film is heated by blowing hot air to fuse it with other fusion film to maintain its shape. Meanwhile, it is permissible to maintain the coil shape by coating wound wires with adhesive agent.

After that, the primary coil 56*c* was disposed inside the outer peripheral wall 56*b* of the primary core 56 and fixed with adhesive agent. As a result, the primary core 56 in which the primary coil 56*c* was provided inside the outer peripheral wall 56*b* is obtained.

On the other hand, in the secondary core 57, wire was wound around an outside of the cylindrical portion 57*a* at required turns corresponding to a use purpose of the transformer so as to form the secondary coil 57*c*. Then, the obtained secondary coil 57*c* was subjected to the processing in which its fusion film was heated by blowing hot air to fuse it with other fusion film to maintain its shape. Meanwhile, it is permissible to maintain the shape by coating the wound wires with adhesive agent. As a result, the secondary core 57 in which the secondary coil 57*c* is provided outside the cylindrical portion 57*a* was obtained.

Next, the primary core 56 was fixed to the stator S and the secondary core 57 was fixed to the rotor R. Then, the stator S and rotor R were disposed such that the primary core 56 and the secondary core 57 oppose each other via a predetermined gap $G_{CR}$. As a result, the isolation transformer 55 in which the primary coil 56*c* and secondary coil 57*c* were accommodated by the primary core 56 and secondary core 57 such that they opposed each other via a predetermined gap $G_{CL}$ was produced.

In the isolation transformer 55, the primary core 56 and secondary core 57 are disposed so as to oppose each other via a predetermined gap $G_{CR}$ such that the cylindrical portion 57*a* of the secondary core 57 is inserted into the inside of the outer peripheral wall 56*b* of the primary core 56. In a space defined by the primary core 56 and secondary core 57, the primary coil 56*c* and secondary coil 57*c* oppose each other via a predetermined gap $G_{CL}$ in the axial direction which is at a different position from the gap $G_{CR}$ Because, in the isolation transformer 55, the position of the gap $G_{CR}$ between the cores 56 and 57 is deviated from the gap $G_{CR}$ between the coils 56*c* and 57*c* substantially by a height (length) of the primary coil 56*c*, the same effect as the above described respective examples is exerted.

Specifically because the isolation transformer 55 is produced only by putting the primary coil 56*c* preliminarily formed inside the outer peripheral wall 56*b* of the primary core 56, a high assembly accuracy for inserting a coil into a fine coil groove is not required, thereby contributing to improvement of production efficiency of the isolation transformer. In the secondary core 57, the secondary coil 57*c* is directly wound around the secondary core 57 as a bobbin and therefore, fitting between the core 57 and coil 57*c* is improved. Further, a procedure for inserting a preliminarily formed coil into a fine coil groove can be omitted, thereby contributing to improvement of production efficiency of the isolation transformer 55.

Figure 18:
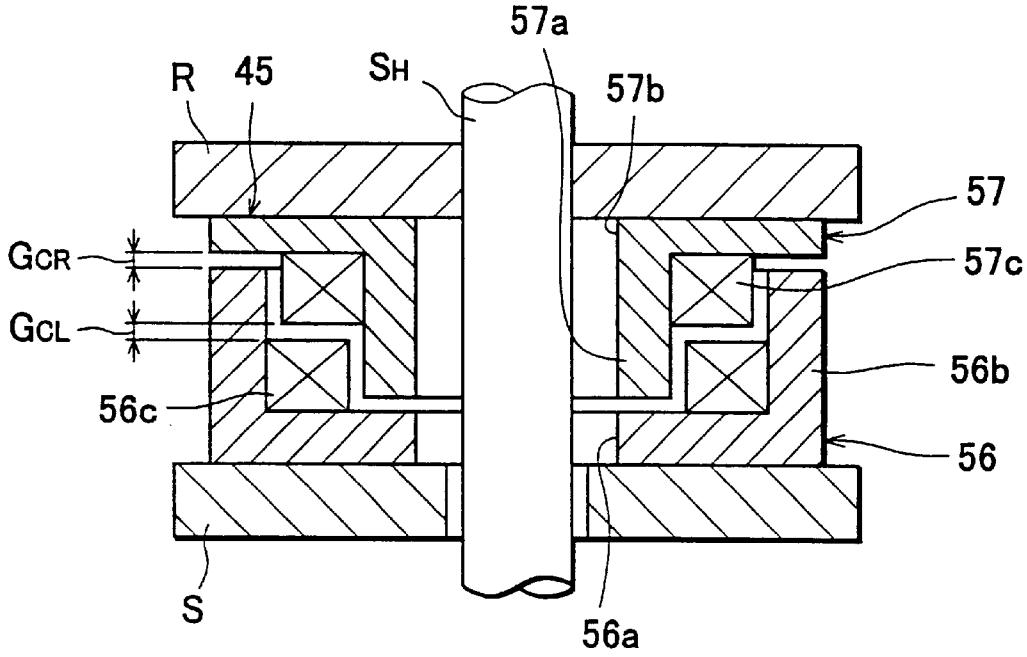
FIG. 18 is a schematic structural diagram of the isolation transformer according to a ninth example.

The isolation transformer 55 is not restricted to such a mode in which a core having the outer peripheral wall 56*b* is the primary core 56 and a core having the cylindrical portion 57*a* in the center thereof is the secondary core 57 as shown in FIG. 18.

Figure 19:
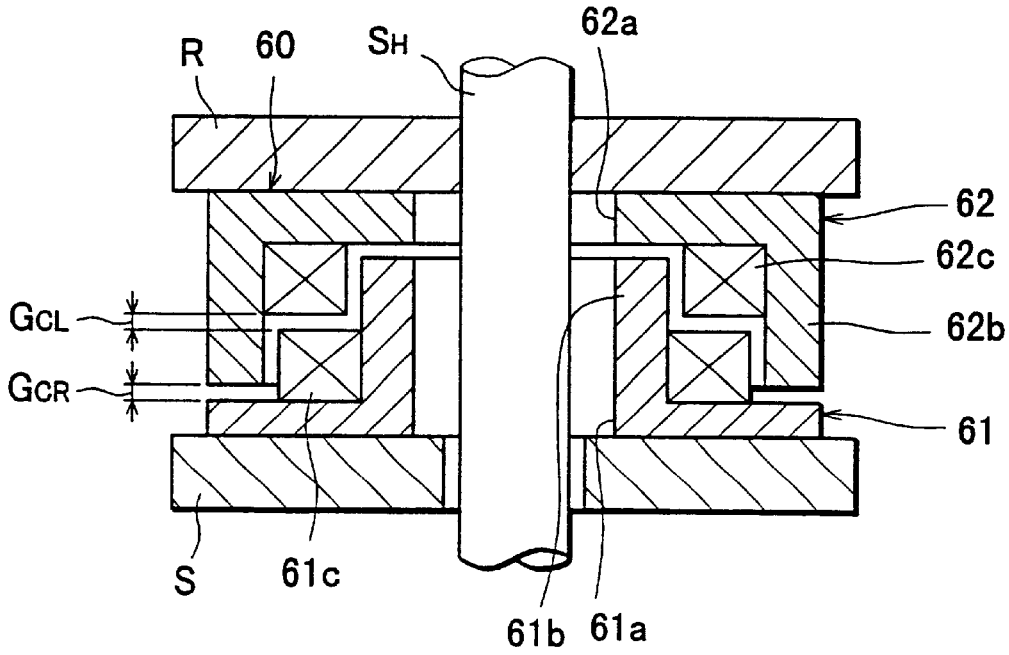
FIG. 19 is a schematic structural diagram showing other mode of the isolation transformer according to the ninth example.

For example, it is permissible that like an isolation transformer 60 shown in FIG. 19, a primary core 61 has a cylindrical portion 61*b* having an insertion hole 61*a* and a secondary core 62 has an outer peripheral wall 62*b* on the periphery thereof in which an insertion hole 62*a* is formed in the center. At this time, a primary coil 61*c* is disposed on an outer periphery of the cylindrical portion 61*b* of the primary core 61. A secondary coil 62*c* is disposed in a condition that it is in a firm contact with an outer peripheral wall 62*b* of the secondary core 62.

Because in the isolation transformer 60, as shown in the Figure, the position of the gap $G_{CR}$ between the cores 61 and 62 is deviated from the gap $G_{CL}$ between the coils 61*c* and 62*c* substantially by a height (length) of the primary coil 61*c*, the same effect as the above described respective examples is exerted.

Figure 20:
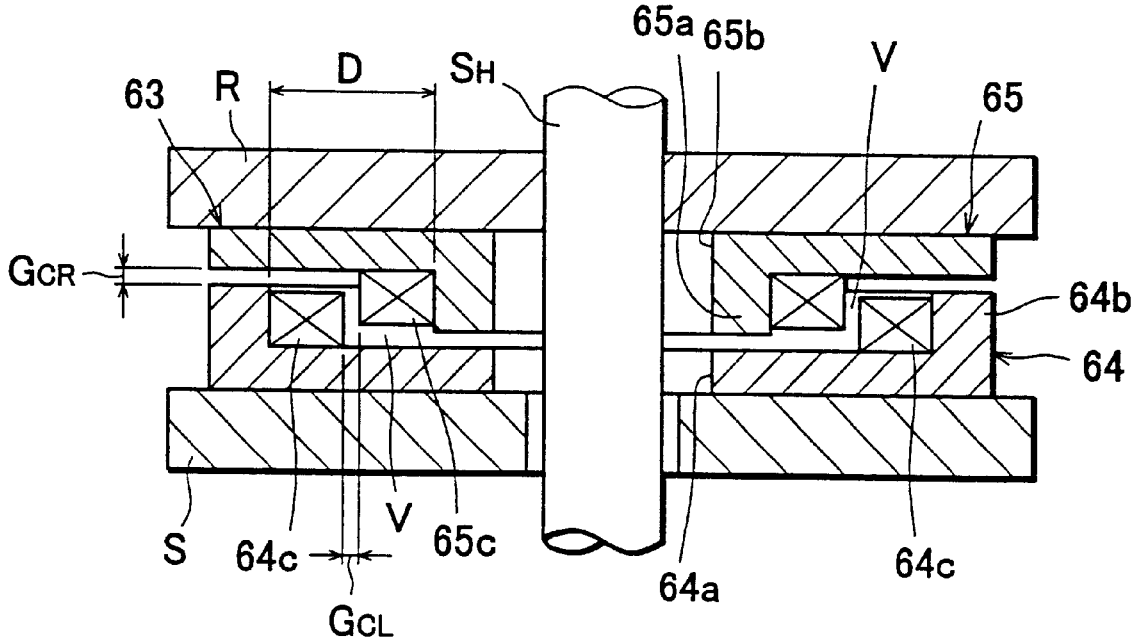
FIG. 20 is a schematic structural diagram of the isolation transformer according to a tenth example.

As a tenth example of the isolation transformer, an isolation transformer 63 as shown in FIG. 20 may be produced.

In the isolation transformer 63, a primary core 64 and a secondary core 65 are disposed so as to oppose each other via a gap $G_{CR}$. A primary coil 64*c* and a secondary coil 65*c* are disposed on the cores 64 and 65 respectively via a gap $G_{CL}$ so that they are inductively coupled.

The primary core 64 is fixed to the stator S and the secondary core 65 is fixed to the rotor R mounted on a rotation shaft $S_H$.

The primary core 64 is formed in a flatter disc shape than the primary core 56 of the isolation transformer 55 of soft magnetic material like soft magnetic ferrite sintered material, having an insertion hole 64*a* in the center thereof and an outer, peripheral wall 64*b* on the periphery. In the primary core 64, the height of the outer peripheral wall 64*b* is set to substantially the same as the height of the primary coil 64*c* which will be described later.

The secondary core 65 is formed in a flat disc shape of soft magnetic material like soft magnetic ferrite sintered material like the primary core 64, in which an insertion hole 65*b* is formed in a cylindrical portion 65*a* provided in the center.

In the secondary core 65, the height of the cylindrical portion 65*a* is set to substantially the same as the height of the secondary coil 65 which will be described later.

The primary coil 64*c* and secondary coil 65*c* are formed in an annular shape entirely having each predetermined inside diameter, having a rectangular section by winding wire at required turns depending on a use purpose of the transformer. In the wire for use, its conductor is covered with polyurethane base insulating film and further polyamide base fusion film is coated the reover. By heating, the aforementioned fusion films are fused with each other to maintain a coil shape.

The primary coil 64*c* is disposed inside the outer peripheral wall 64*b* of the primary core 64 and the secondary coil 65*c* is disposed outside the cylindrical portion 65*a* of the secondary core 65.

The isolation transformer having such a structure was produced in the following manner.

First, the primary core 64 in which the primary coil 64*c* was provided inside the outer peripheral wall 64*b* and the secondary core 65 in which the secondary coil 65*c* was provided on the outer periphery of the cylindrical portion 65*a* were produced.

The primary core 64 was fixed to the stator S and the secondary core 65 was fixed to the rotor R. Then, the stator S and rotor R were disposed so that the primary core 64 and secondary core 65 oppose each other via a predetermined gap $G_{CR}$. As a result, the isolation transformer 63 in which the primary coil 64*c* and secondary coil 65*c* were accommodated by the primary core 64 and secondary core 65 was produced.

In the isolation transformer 63, the primary core 64 and secondary core 65 are disposed so as to oppose each other via a predetermined gap $G_{CR}$ in a condition that the cylindrical portion 65*a* of the secondary core 65 is inserted into inside of the outer peripheral wall 64*b* of the primary core 64. In a space V defined by the primary core 64 and secondary core 65, the primary coil 64*c* and secondary coil 65*c* are disposed so as to oppose each other via a predetermined gap $G_{CL}$ in the diameter direction.

A dimension D in the diameter direction of the space V defined when the primary core 64 and secondary core 65 are disposed so as to oppose each other is set to such a length allowing the primary coil 64*c* and secondary coil 65*c* to be disposed via a gap $G_{CL}$ of a desired dimension in the diameter direction. Thus, the dimensions of the cores 64, 65 and coils 64*c*, 65*c* are set to predetermined values capable of securing the dimension D.

In the isolation transformer 63 having such a structure, the direction of the gap $G_{CR}$ between the cores 64 and 65 intersects with the direction of the gap $G_{CR}$ between the coils 64*c* and 65*c*. Thus, the isolation transformer 63 is capable of interlinking leakage magnetic flux generated in the gap $G_{CR}$ between the cores 64 and 65 with the secondary coil 65*c* further securely, so that it is capable of exerting the same effect as the isolation transformer 34 according to the fourth example shown in FIG. 11. Particularly because in the isolation transformer 63, the dimensions in the axial direction can be made small, it can be preferably used in a case in which a restriction on dimension in the axial direction at an installation position is strict.

Meanwhile, the isolation transformer 63 is not restricted to a mode in which a core having the outer peripheral wall 64*b* is the primary core 64 and a core having the cylindrical portion 65*a* in the center is the secondary core 65 as shown in FIG. 20.

Figure 21:
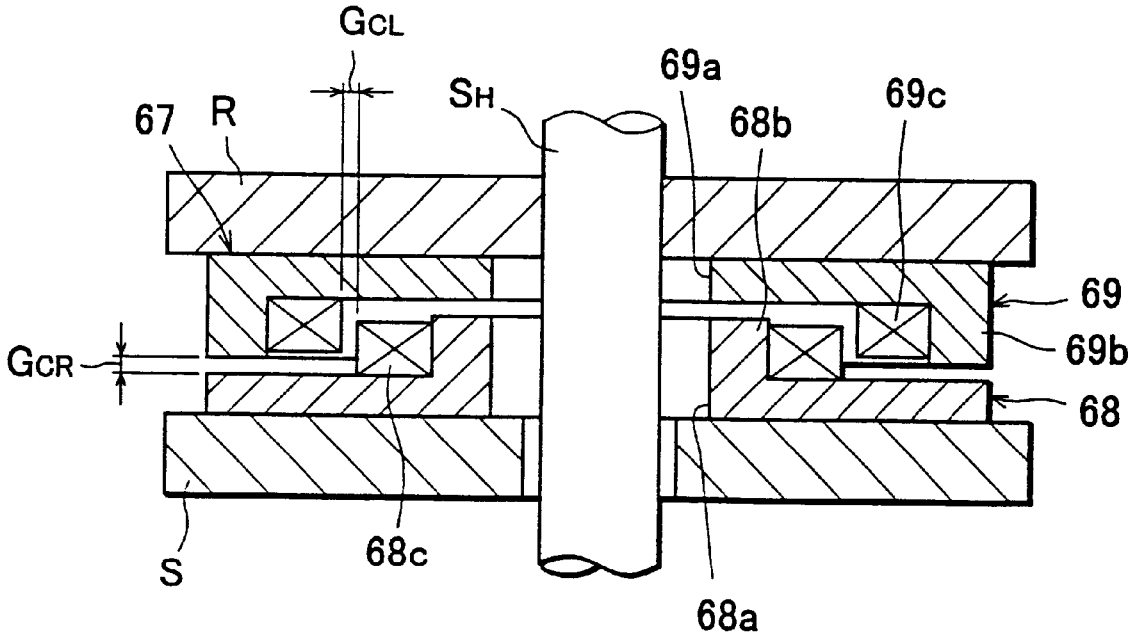
FIG. 21 is a schematic structural diagram showing other mode of the isolation transformer according to the tenth example.

For example, it is permissible that like an isolation transformer 67 shown in FIG. 21, its primary core 68 has a cylindrical portion 68*b* at a center having an insertion hole 68*a* and its secondary core 69 has an outer peripheral wall 69*b* in which an insertion hole 69*a* is formed in the center. At this time, the primary coil 68*c* is disposed on the outer peripheral face of the cylindrical portion 68*b* of the primary core 68. The secondary coil 69*c* is disposed such that it is in a firm contact with the outer peripheral wall 69*b* of the secondary core 69.

The isolation transformer for achieving the second object is not restricted to the above described respective examples. For example, inductance or the like of each coil may be determined corresponding to electric energy transmission specification. The size, shape and the like of each core may be determined depending on a specification thereon and further, formation material, dimension of the gap $G_{CR}$ and the like may be determined depending on a required specification.

In this example, core formation material is not restricted to a particular one as long as it is applicable for transmission of high frequency signal (having a high volume resistivity), but soft magnetic ferrite material which is cheap and most suitable for transmission of high frequency signal is preferable. The soft magnetic ferrite material mentioned here includes soft magnetic ferrite sintered material such as Mn—Zn base ferrite, Ni—Zn base ferrite, and soft magnetic resin in which soft magnetic ferrite powder such as Ni—Zn, Mn—Zn is mixed in synthetic resin by a predetermined quantity and the like.

Although in the respective examples, the primary coil and secondary coil are disposed inside the secondary core, it is permissible to form a concave portion in the primary core and dispose the primary coil and secondary coil inside the primary core. The present invention may be carried out in various modifications in a range not departing from a gist thereof.

In the above respective examples for achieving the second object, cases in which the rotary transformer is used as the isolation transformer have been described. However, the isolation transformer may be a type in which electric power is transmitted by making the primary core and secondary core disposed to oppose approach or leave each other.

On the other hand, the isolation transformers of the above respective examples have been described about a case in which the primary core is fixed to the stator S and the secondary core is fixed to the rotor R. However, it is needless to say that in the isolation transformer, the primary core is fixed to the rotor R and secondary core is fixed to the stator S.

An example of a transmission control apparatus using the isolation transformer of the present invention for achieving the aforementioned third object will be described in detail with reference to FIGS. 22–30.

Figure 22:
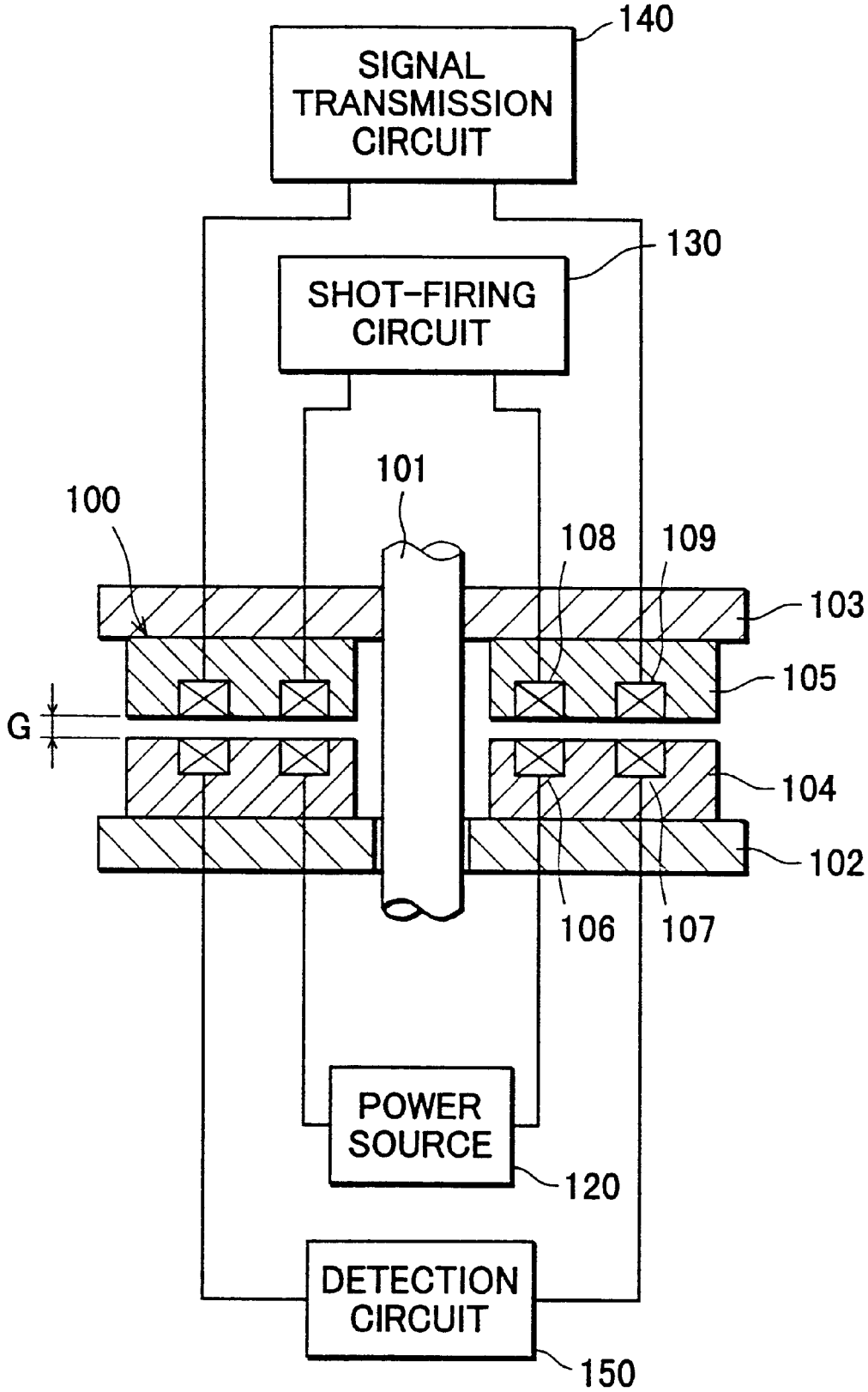
FIG. 22 is a schematic structural diagram of a transmission control apparatus for achieving a third object of the present invention.

FIG. 22 is a schematic structure diagram of the transmission control apparatus of the present invention. Referring to FIG. 22, the transmission control apparatus comprises a rotary transformer 100, high output signal transmission means for electric power transmission system having a power source 120 connected to the rotary transformer 100 and shot-firing circuit 130, and low output signal transmission means for signal transmission system having a signal transmission circuit 140 and a detection circuit 150.

In the rotary transformer 100, a primary core 104 and a secondary core 105 are disposed so as to oppose each other via a gap G and attached to the stator 102 and rotor 103 respectively disposed around a shaft 101. The stator 102 is mounted to a column (not shown) side and the rotor 103 is fixed to the shaft 101. Primary coils 106, 107 and secondary coils 108, 109 are mounted in plural annular concave portions formed separately from each other on each of opposing faces of the cores 104, 105.

Figure 23:
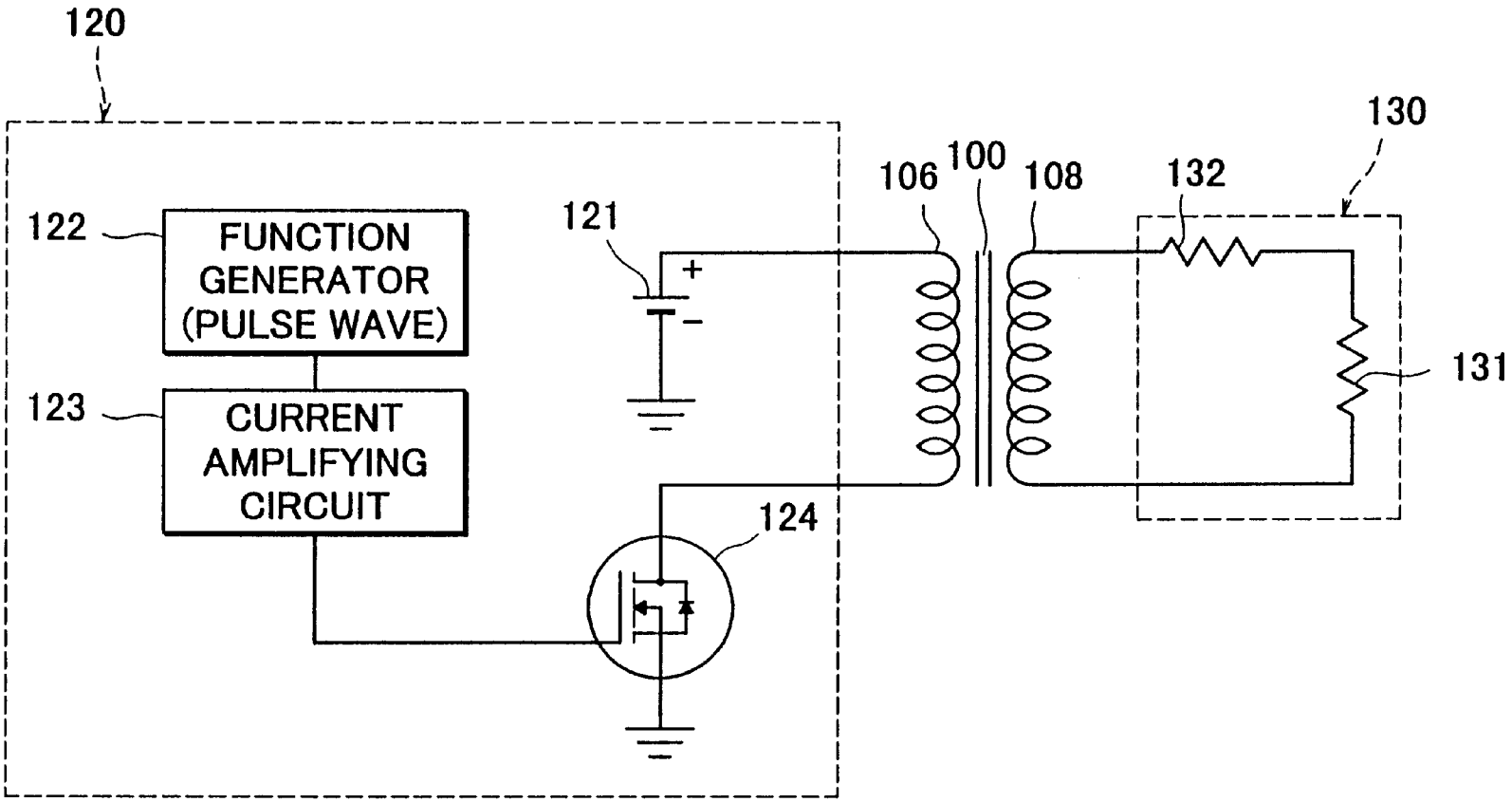
FIG. 23 is a circuit diagram showing an example of a circuit structure of a high output signal transmission means comprising the rotary transformer shown in FIG. 22, a power source and shot-firing circuit.

In the rotary transformer 100, the power source 120 is connected to the primary coil 106 and the shot-firing circuit 130 is connected to the secondary coil 108 inductively coupled with the primary coil 106, so that electric power is supplied from the power source 120 of the column side to the shot-firing circuit 130 of the shaft side. Because the secondary coil 108 is directly connected to the shot-firing circuit 130 having a low resistance value as shown in FIG. 23, the number of windings of the coil is limited so as to reduce coil impedance. That is, according to this example, for example, to feed power to the shot-firing resistor 131 of 2Ω, it is assumed that core having a relative magnetic permeability of 10 is used for material of the primary core 104 and secondary core 105 and that the number of windings of the primary coil 106 is 3 and the number of windings of the secondary coil 108 is 6.

The power source 120 for feeding current to the primary coil 106 comprises, as shown in FIG. 23, a vehicle battery 121 connected to an end of the primary coil 106, a function generator 122 and a power amplifying circuit 123 connected to the other end of the primary coil 106 via a MOS transistor 124, and utilizes switching power source for outputting a pulse wave of voltage 12V(pulse peak value) and transmission frequency of 20 KHz. Reference numeral 132 in the Figure indicates a resistor for current measurement like a precision resistor.

Figure 24:
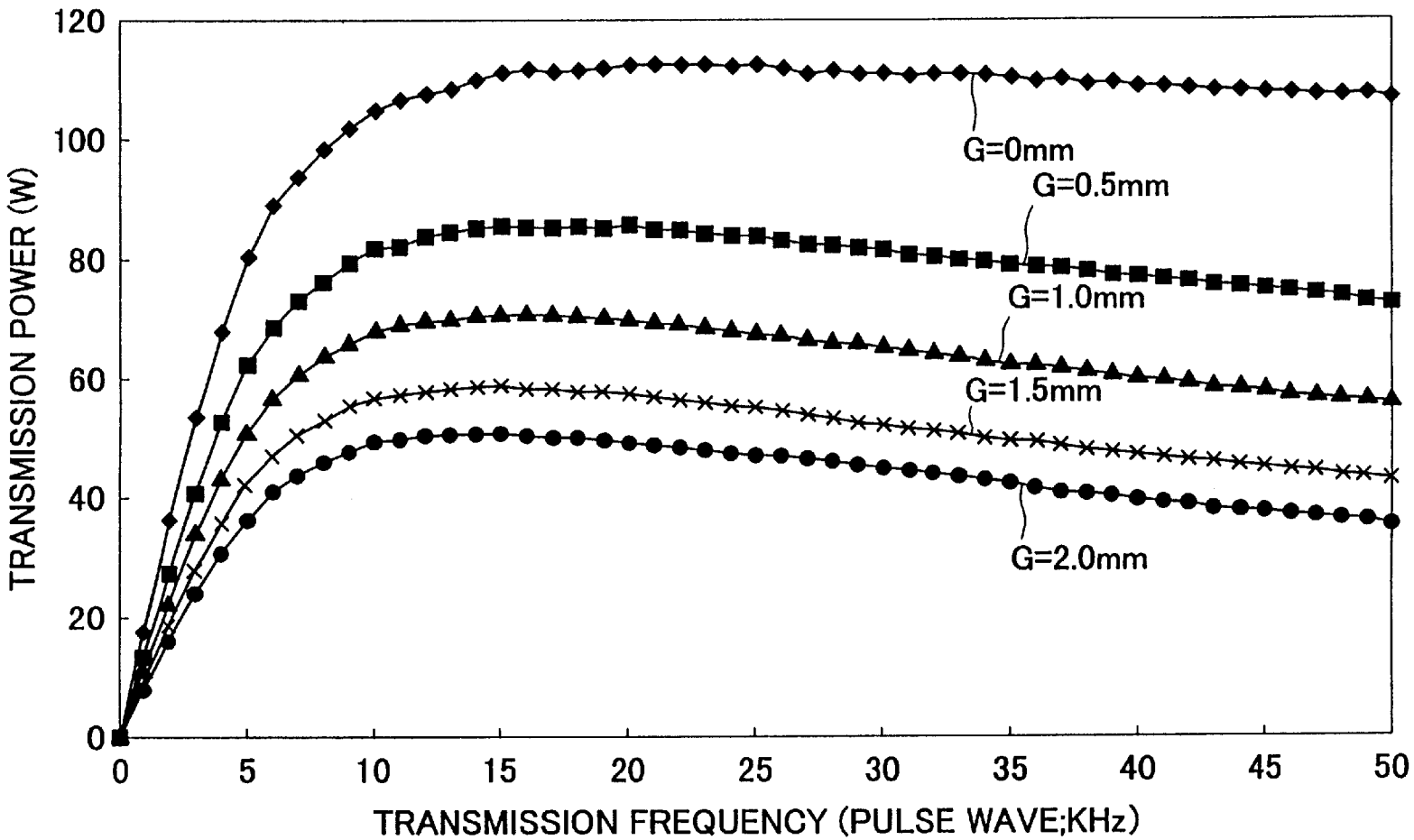
FIG. 24 is a characteristic diagram showing a frequency response characteristic of transmission power in the transmission control apparatus.

The inventors measured a frequency response characteristic of transmission power by the aforementioned transmission control apparatus and as a result, a characteristic as shown in FIG. 24 was obtained. That is, FIG. 24 shows gap G, transmission frequency and transmission power in a condition in which the shot-firing resistor 131 of the aforementioned transmission control apparatus is 2Ω. For example, in case where the gap G between the coils 106 and 108 is 1.0 mm, about 70W transmission power can be achieved. Because the maximum delay time in transmission from a firing start instruction corresponds to a half wave of transmission frequency, the delay is as small as 25 $\mu$ second since a cycle is 50 $\mu$ second if the transmission frequency is 20 KHz.

In FIG. 22, the detection circuit 150 is connected to the primary coil 107 and the signal transmission circuit 140 is connected to the secondary coil 109 inductively coupled with the primary coil 107. As a result, the aforementioned transmission control apparatus is capable of transmitting a signal from the signal transmission circuit 140 of the shaft side to the detection circuit 150 of the column side.

Figure 25:
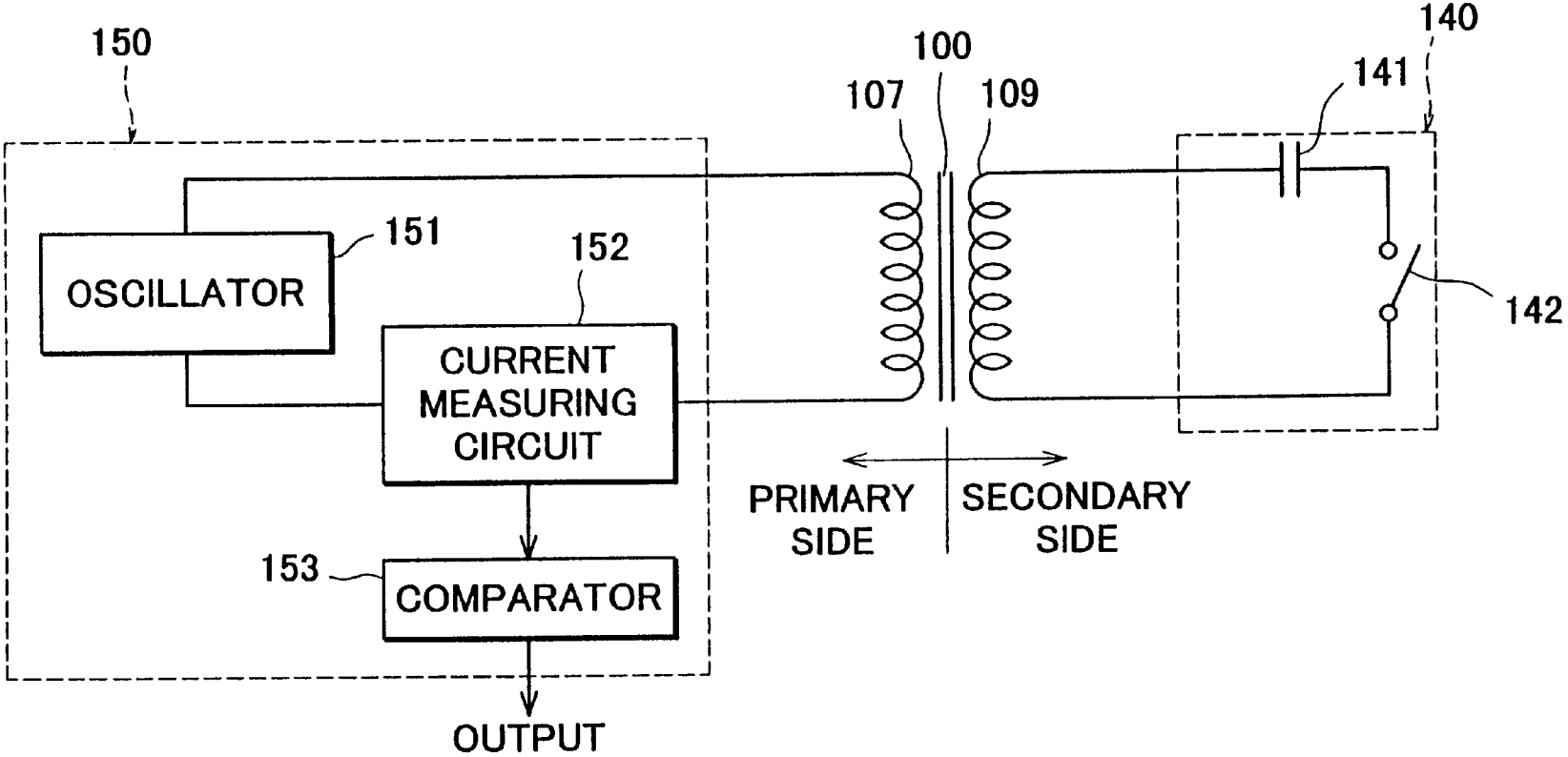
FIG. 25 is a circuit diagram showing a first example of a circuit structure of a low output signal transmission means comprising the rotary transformer, signal transmission circuit and detection circuit.

In this example, for example, a case of transmission by only a starting switch in a horn will be described. In the signal transmission circuit 140, as shown in FIG. 25, a capacitor 141 and a starting switch 142 are connected in series to the secondary coil 109. The capacitor 141 and the secondary coils 108, 109 of the rotary transformer 100 form a single series resonant circuit. The resonance frequency of the resonant circuit is fk. The detection circuit 150 comprises an oscillator 151 connected to the primary coil 107, a current measuring circuit 152 and a comparator 153 connected to the current measuring circuit 152. An oscillation frequency of the oscillator 151 is set to the same frequency fk. A constant voltage alternating signal of the frequency fk is applied from the oscillator 151 to the coil 107. If the starting switch is turned ON, the secondary circuit of the rotary transformer 100 is a closed loop, providing series resonant condition. As well known, in case where the series resonant circuit becomes resonant, the impedance of the loop is minimized and resonant current is maximized. Therefore, the impedance of the primary coil is reduced so that a supply current to the oscillator 151 is increased. The current measuring circuit 152 and comparator 153 detect a maximum value of current so as to notify that the starting switch 142 of the secondary side has been turned ON with output signal.

According to this example, the low output signal transmission means utilizes a core having a relative magnetic permeability of 10 as the core material and the number of windings of the primary coil 107 and secondary coil 109 is set to 20. As the capacitor 141, a type having a capacity capable of being resonant with 100 KHz is designed or selected and it is capable of detecting a change in current accompanied by turning ON/OFF of the starting switch 142 on the primary side.

Therefore, as for ignition of an air bag, this example enables to ignite the air bag surely by feeding a current to the shot-firing circuit on the rotor side without any delay of time and even if information is generated from the rotor side for this while, it can be transmitted effectively to the column side.

The vehicle signal transmission system contains a signal transmission system for monitoring a plurality of opening/closing operations of auto cruise function switch, air conditioner switch and the like as well as horn start switch.

Figure 26:
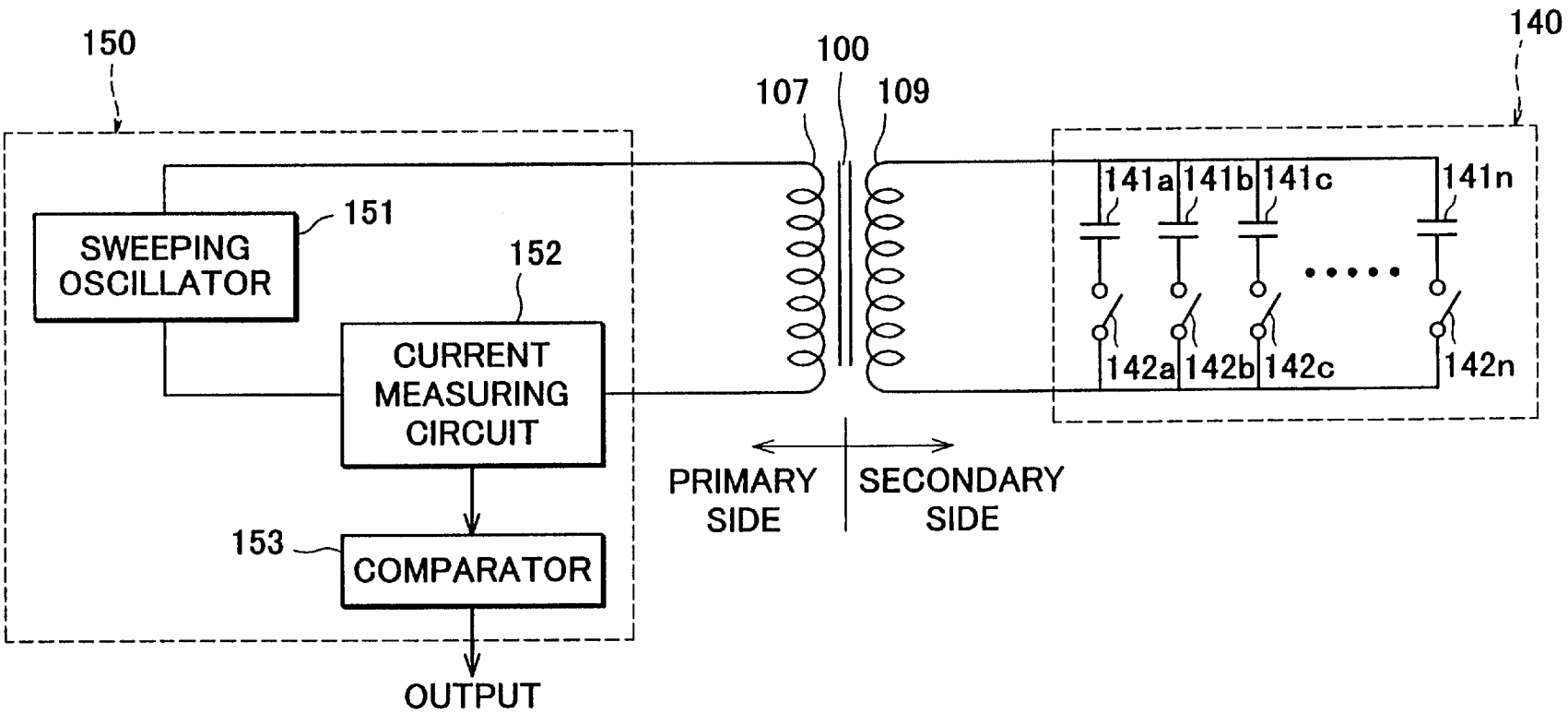
FIG. 26 is a circuit diagram showing a second example of a circuit structure of the low output signal transmission means.

According to the present invention, in a signal transmission circuit 140 according to the second example as shown in FIG. 26, a plurality of capacitors 141*a*–141*n* and switches 142*a*–142*n* are connected to the secondary coil 109 in parallel corresponding to a quantity of signal transmission systems. Then, a difference in resonant frequency in the secondary circuit which changes depending on opening/closing of each switch can be detected by changing the frequency continuously and cyclically with a sweep oscillator 154.

As for ignition of the air bag, this example enables to ignite the air bag surely by feeding a current to the shot firing circuit on the rotor side without any delay of time and further, transmit various information from the rotor side to the column side effectively.

Figure 27:
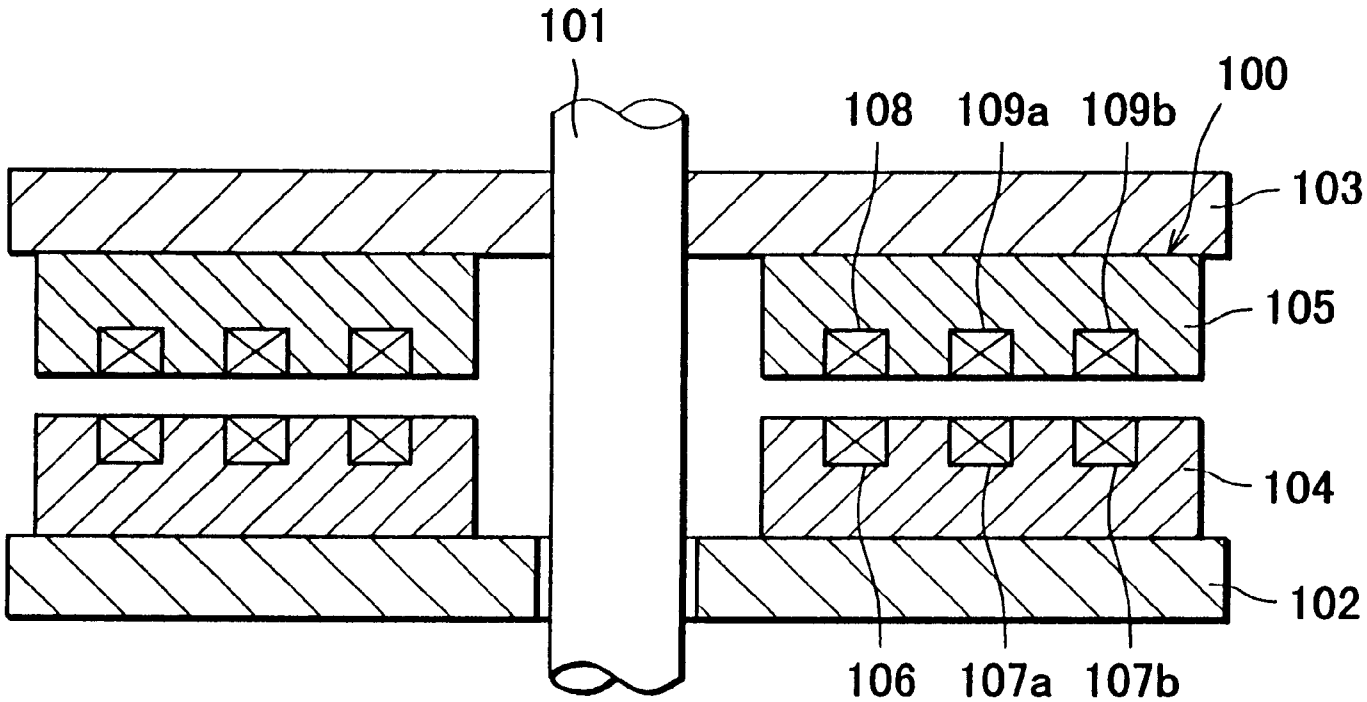
FIG. 27 is a schematic structural diagram showing an eleventh example of the rotary transformer for use in the transmission control apparatus.

In case where a plurality of signal transmission systems exist like this, a plurality (three in this case) of annular concave portions are formed so as to be spaced in opposing faces of the primary core 104 and secondary core 105 as shown in FIG. 27 and the primary coils 106, 107*a*, 107*b* and secondary coils 108, 109*a*, 109*b* are mounted in the respective concave portions. Then, power transmission system for air bag ignition and various signal transmission system are connected to the primary coil and secondary coil inductively coupled so as to transmit a signal for air bag ignition and a signal which changes by opening/closing of the switch. Although in this example, the number of tracks formed by the primary coil and secondary coil is three, the present invention is not restricted to this number, but the number of the tracks may be four or more.

Because, in this example, when the air bag needs to be ignited, the air bag gets into a condition allowing the ignition without any delay of time and plural information can be transmitted at the same time, the transmission efficiency can be increased further.

Figure 28A:
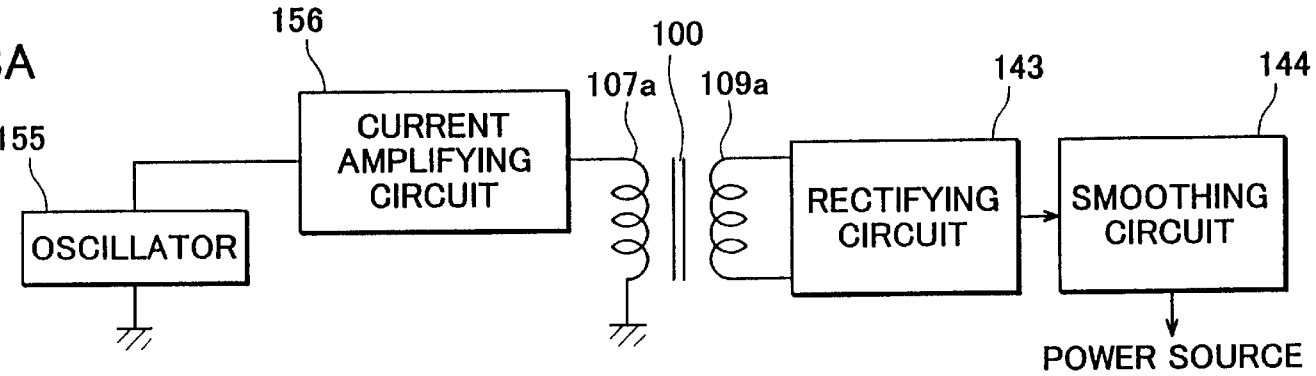
FIGS. 28A, 28B are circuit diagrams showing an example of a circuit structure of the transmission control apparatus of the present invention.
Figure 28B:
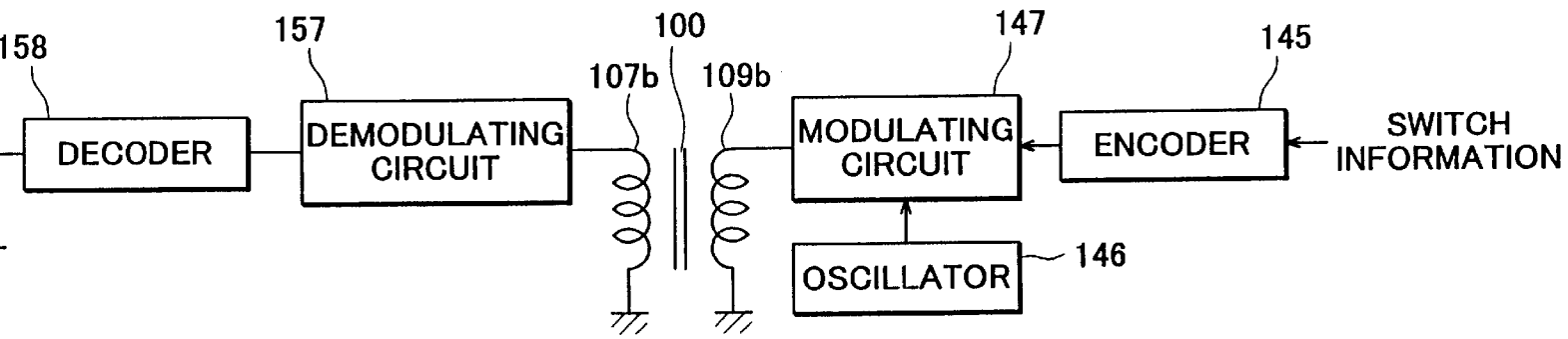
Figure 29:
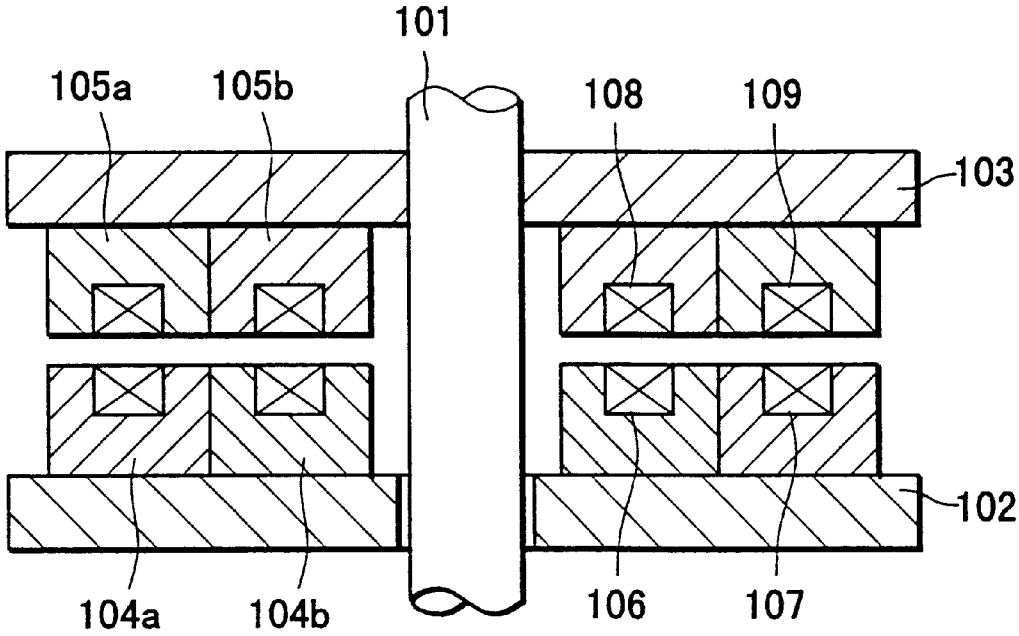
FIG. 29 is a schematic structural diagram showing a twelfth example of the rotary transformer for use in the transmission control apparatus.

FIGS. 28A and 28B are circuit diagrams showing an example of a circuit structure of transmission control apparatus for transmitting information generated on the secondary side to the primary side without using the resonant circuit system shown in FIG. 26. In this case, the rotary type transformer shown in FIG. 27 is used. An oscillator 155 and a current amplifying circuit 156 are connected to the primary coil 107*a* shown in FIG. 28A and a rectifying circuit 143 and a smoothing circuit 144 are connected to the secondary coil 109*a* so as to supply low power necessary for driving the signal transmission circuit to the secondary side. As a result, it is possible to encode information from a signal transmission circuit comprising an encoder 145, an oscillator 146 and a modulating circuit 147, transmit from the secondary coil 109*b* to the primary coil 107*b*, decode the information by a demodulation circuit 157 connected to the primary coil 107 and a decoder 158 and output it to the column side.

This example enables not only certain air bag ignition and simultaneous transmission of information, but also supply of power to the signal transmission circuit.

The above respective examples have been described about a case in which the relative magnetic permeability of core material used in the rotary transformer is the same. However, the impedance of the coil and mutual inductance between coils, which are required for the rotary transformer vary depending on application purpose, and it has been known that the design thereof differs depending on the number of windings of the coil, relative magnetic permeability of core material, application frequency and impedance of a load circuit. Thus, according to the present invention, it is possible to change materials for the primary cores 104*a*, 104*b* and secondary cores 105*a*, 105*b* used in each track formed by the primary coils 106, 107 and secondary coils 108, 109 inductively coupled, so as to optimize the relative magnetic permeability of each thereof to a different value. In case where the relative magnetic permeability of the core material is divided to two types (materials of the cores 104*a*, 105*a* and cores 104*b*, 105*b*) like this example, because the entire secondary circuit of the power transmission system needs to be of low impedance, a core material having a low relative magnetic permeability, for example, core material having relative magnetic permeability 10 is used and because, in the signal transmission system, the entire circuit impedance can be set relatively high, material having a high relative magnetic permeability to ensure an excellent coupling efficiency, for example, core material having relative magnetic permeability of 100 is used.

This example includes an effect that the freedom on design is increased in addition to the above described effects of the respective examples.

In the isolation transformer for use in the transmission control apparatus of the present invention, cores of material having a high magnetic permeability are disposed in a path of interlinkage magnetic flux between coils and a sectional area perpendicular to the interlinkage magnetic flux of the core is different depending on power level of the signal.

In case of transmission of large electric power like a case of air bag ignition, due to saturated magnetic flux, cores of material having a high magnetic permeability are disposed in a path of interlinkage magnetic flux between the coils and the sectional area perpendicular to the interlinkage magnetic flux of the core needs to be large. In case of signal transmission, because it is a small power, cores of material having a high magnetic permeability are disposed in path of interlinkage magnetic flux between the coils and the sectional area perpendicular to the interlinkage magnetic flux of the core may be small.

Figure 30:
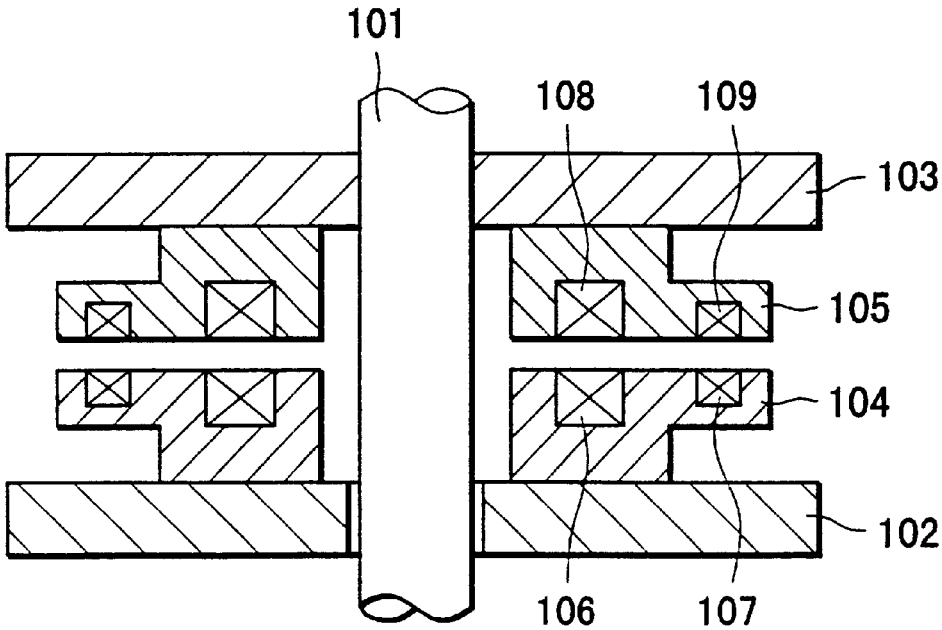
FIG. 30 is a schematic structural diagram showing a thirteenth example of the rotary transformer for use in the transmission control apparatus.

According to an example shown in FIG. 30, the thickness of the primary core 104 and secondary core 105 is adjusted depending on the type of transmission system connected to the rotary transformer or power level so as to change the sectional area of the core portion.

This example has an effect that the entire weight of the rotary transformer can be reduced in addition to the effects of the above described example.

The above respective examples have been described about a case in which the isolation transformer is mounted on an automotive steering apparatus.

However, needless to say, the application object of the isolation transformer of the present invention is not restricted to the steering apparatus as long as the relatively-rotary fixed member and rotating member thereof are electrically connected without any direct contact so that electric power or electric signal can be transmitted between both the members without a contact and this is also applicable for a hinge portion of a vehicle door and a case of electrically connecting robot arms having each freedom of rotation without a contact and the like.

INDUSTRIAL APPLICABILITY

Because, according to the invention for achieving the first object, the coupling coefficient between the coils can be intensified using the shielding effect of the coil relative to magnetic flux, even if the gap between the cores is set large, the isolation transformer capable of suppressing a drop of the coupling condition between the coils can be provided. Further, if the number of windings of the coil is decreased, the isolation transformer is capable of making effective use of the coil winding space.

Further, according to the invention for achieving the first object, even if the insulating gap between the coil conductors is increased, a large shielding conductor area is ensured corresponding to the horizontal factor or vertical factor of magnetic flux crossing the conductor. Therefore, a drop of the coupling condition due to the size of the insulating gap can be suppressed further.

According to the invention for achieving the second object, the leakage magnetic flux interlinks with the secondary coil because the position of the gap between the cores is different from the position of the gap between the coils in terms of plane and magnetic resistance of a magnetic circuit of the leakage magnetic flux is raised by providing with the shielding body having a high conductivity along a magnetic path formed by the cores. Therefore, the leakage magnetic flux generated by the gap between the cores is effectively suppressed and the coupling coefficient between the coils is raised sufficiently. As a result, the efficiency of electric energy transmission can be raised while relaxing a dimensional restriction, of the core relative to the gap. Therefore, even in case where large-current electric energy is transmitted instantaneously, that energy transmission can be carried out effectively.

Further, the system structure is simple so that the accuracy in production of the cores and coils and assembly precision can be relaxed. Thus, the production cost can be largely reduced, and other practical effects such as stabilization of the operation thereof against disturbance factors such as vibration are produced.

According to the invention for achieving the third object, in the transmission control apparatus for controlling transmission of a high output signal for air bag ignition and a low output signal for transmission of various information, the power transmission system for transmitting the high output signal and signal transmission system for transmitting the low output signal are connected to the primary coil and secondary coil wound around the primary core and secondary core respectively separately of the rotary transformer. Therefore, both the transmission systems can be separated and as a result, a large current can be supplied without any delay of time when the air bag ignition is required, so as to ignite the air bag securely. Further, information from the rotor side of the rotary transformer can be obtained at the same time effectively.

What is claimed is:

1. A transmission control apparatus for controlling transmission of a high output signal for air bag ignition and a low output signal for transmission of other information, said transmission control apparatus comprising:

an isolation transformer having a primary core, a secondary core disposed to oppose said primary core with a predetermined gap therebetween, and at least first and second primary coils and first and second secondary coils attached to said primary core and said secondary core respectively such that said first primary coil is inductively coupled to said first secondary coil and such that said second primary coil is inductively coupled to said second secondary coil;

high output signal transmission means connected to said first primary coil and said first secondary coil for transmitting the high output signal; and low output signal transmission means connected to said second primary coil and said second secondary coil for transmitting said low output signal;

wherein an input/output impedance between said first primary coil and said first secondary coil which are inductively coupled to each other is lower than an input/output impedance between said second primary coil and said second secondary coil which are inductively coupled to each other;

wherein the high output signal transmitted by said high output signal transmission means has a lower frequency than the low output signal transmitted by said low output signal transmission means; and wherein said high, output signal transmission means comprises a power source connected to said first primary coil and a shot-firing circuit connected to said first secondary coil, and a number of windings of said first primary coil is less than a number of windings of said first secondary coil.

* * * * *